US007029837B2

(12) United States Patent
Fenton et al.

(10) Patent No.: US 7,029,837 B2
(45) Date of Patent: Apr. 18, 2006

(54) PHOTOGRAPHIC FILM ELEMENT CONTAINING AN EMULSION WITH DUAL PEEK GREEN RESPONSIVITY

(75) Inventors: David E. Fenton, Fairport, NY (US); Lois A. Buitano, Potomac, MD (US); Steven G. Link, Rochester, NY (US); Sharon G. Johnston, Rochester, NY (US); David B. Moorehouse, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/732,956

(22) Filed: Dec. 11, 2003

(65) Prior Publication Data

US 2005/0130083 A1 Jun. 16, 2005

(51) Int. Cl.
*G03C 1/12* (2006.01)

(52) U.S. Cl. ..... 430/570; 430/572

(58) Field of Classification Search ..... 430/570, 430/572

See application file for complete search history.

(56) References Cited

U.S. PATENT DOCUMENTS

| | | | | |
|---|---|---|---|---|
| 3,672,898 A | | 6/1972 | Schwan et al. | |
| 4,599,301 A | * | 7/1986 | Ohashi et al. | 430/505 |
| 4,705,744 A | | 11/1987 | Sasaki et al. | 430/504 |
| 4,707,436 A | | 11/1987 | Sasaki et al. | 430/505 |
| 5,053,324 A | | 10/1991 | Sasaki et al. | 430/504 |
| 5,166,042 A | | 11/1992 | Nozawa | 430/504 |
| 5,200,308 A | | 4/1993 | Ohtani et al. | 430/508 |
| 5,258,273 A | | 11/1993 | Ezaki et al. | 430/509 |
| 5,308,748 A | | 5/1994 | Ikegawa et al. | 430/574 |
| 6,093,526 A | | 7/2000 | Buitano et al. | 430/574 |
| 6,296,994 B1 | | 10/2001 | Sowinski et al. | 430/505 |
| 6,479,226 B1 | | 11/2002 | Heki | 430/506 |
| 6,656,670 B1 | * | 12/2003 | Sato et al. | 430/504 |
| 6,740,481 B1 | * | 5/2004 | Nagaoka et al. | 430/508 |

FOREIGN PATENT DOCUMENTS

| | | |
|---|---|---|
| EP | 447 138 A1 | 9/1991 |
| EP | 458 315 A1 | 11/1991 |

* cited by examiner

*Primary Examiner*—Hoa Van Le
(74) *Attorney, Agent, or Firm*—Sarah Meeks Roberts

(57) ABSTRACT

This invention relates to a silver halide photographic element comprising a support bearing a cyan dye image forming unit comprised of at least one red sensitive silver halide emulsion, a magenta dye image forming unit comprised of at least one green sensitive silver halide emulsion, and a yellow dye image forming unit comprised of at least one blue sensitive silver halide emulsion; wherein the at least one green sensitive silver halide emulsion comprises two absorptance peaks, the first peak being between 515 and 540 nm (short wavelength peak) and the second peak being between 565 and 590 nm, (long wavelength peak) and wherein (a) the ratio of the absorptance peak value of the short wavelength peak to the absorptance peak value of the long wavelength peak is from 0.65 to 1.55;
(b) the absorptance minimum between the two absorptance peaks is between 530 and 560 nm;
(c) the ratio of the absorptance value at the absorptance minimum to that of the smaller absorptance peak is 0.86 or less;
(d) the ratio of the absorptance at 490 nm to that of the highest absorptance peak is 0.60 or less.

16 Claims, No Drawings

PHOTOGRAPHIC FILM ELEMENT CONTAINING AN EMULSION WITH DUAL PEEK GREEN RESPONSIVITY

FIELD OF THE INVENTION

The invention relates to silver halide color photographic light sensitive materials and in particular to silver halide color photographic materials giving superior color reproduction for scenes illuminated by emissions from some artificial light sources.

DEFINITION OF TERMS

The term "E" is used to indicate exposure in lux-seconds.

The term "Status M density" is used to indicate image dye densities measured by a densitometer meeting photocell and filter specifications described in *SPSE Handbook of Photographic Science and Engineering*, W. Thomas, editor, John Wiley & Sons, New York, 1973, Section 15.4.2.6 Color Filters. The International Standard for Status M density is set out in "Photography—Density measurements—Part 3: Spectral conditions", Ref. No. ISO 5/3-1984 (E).

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "colored masking coupler" indicates a coupler that is initially colored and that loses its initial color during development upon reaction with oxidized color developing agent.

The term "dye image-forming coupler" indicates a coupler that reacts with oxidized color developing agent to produce a dye image.

The term "development inhibitor releasing compound" or "DIR" indicates a compound that cleaves to release a development inhibitor during color development. As defined DIR's include couplers and other compounds that utilize anchimeric and timed releasing mechanisms.

In referring to grains and emulsions containing two or more halides, the halides are named in order of ascending concentrations.

The terms "high chloride" and "high bromide" in referring to grains and emulsions indicate that chloride or bromide, respectively, is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "blue spectral sensitizing dye", "green spectral sensitizing dye", and "red spectral sensitizing dye" refer to a dye or combination of dyes that sensitize silver halide grains and, when adsorbed, have their peak absorption in the blue, green and red regions of the spectrum, respectively.

The term "absorptance peak" or "absorptance maximum" refers to a local maximum value of absorptance in a table or graph of data comprising absorptance values as a function of wavelength. An "absorptance peak" exists when the value of the absorptance is lower at wavelengths immediately less than and immediately greater than at the wavelength of the absorptance peak.

The term "absorptance minimum" refers to a local minimum value of absorptance in a table or graph of data comprising absorptance values as a function of wavelength. An "absorptance minimum" exists when the value of the absorptance is higher at wavelengths immediately less than and immediately greater than at the wavelength of the absorptance minimum.

*Research Disclosure* is published by Kenneth Mason Publications, Ltd., Dudley House, 12 North St., Emsworth, Hampshire PO10 7DQ, England.

BACKGROUND OF THE INVENTION

Color photographic elements are conventionally formed with superimposed blue, green, and red recording layer units coated on a support. The blue, green, and red recording layer units contain radiation-sensitive silver halide emulsions that form a latent image in response to blue, green, and red light, respectively. Additionally, the blue recording layer unit generally contains a yellow dye-forming coupler, the green recording layer unit generally contains a magenta dye-forming coupler, and the red recording layer unit generally contains a cyan dye-forming coupler.

Following imagewise exposure, a negative working photographic element is processed in a color developer that contains a color developing agent that is oxidized while selectively reducing to silver the latent image bearing silver halide grains. The oxidized color developing agent then reacts with the dye-forming coupler in the vicinity of the developed grains to produce an image dye. Yellow (blue-absorbing), magenta (green-absorbing) and cyan (red-absorbing) image dyes are formed in the blue, green, and red recording layer units, respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce corresponding positive dye images, and hence, to produce a visual approximation of the hues of the subject photographed, white light is typically passed through the color negative image to expose a second color photographic material having blue, green, and red recording layer units as described above, usually coated on a white reflective support. The second element is commonly referred to as a color print element. Processing of the color print element as described above produces a viewable positive image that approximates that of the subject originally photographed.

A positive working color photographic element is first developed in a black-and-white developer where the exposed crystals are selectively reduced to metallic silver. The unexposed silver is then fogged and reduced by a chromogenic color developer in a subsequent step to generate cyan, magenta, and yellow image dyes. The film is further bleached and fixed as with the negative working film.

The positive working film thus forms dyes in the unexposed areas and renders a positive image of the scene, directly.

A problem with the accuracy of color reproduction delayed the commercial introduction of color negative elements. In color negative imaging, two dye image-forming coupler containing elements, a camera speed image capture and storage element and an image display, i.e., print element, are sequentially exposed and processed to arrive at a viewable positive image. Since the color negative element cascades its color errors forward to the color print element, the cumulative error in the final print is unacceptably large, absent some form of color correction. Even in color reversal materials which employ just one set of image dyes, color correction for the unwanted absorption of the imperfect image dyes is required to produce acceptable image color fidelity for direct viewing.

The complicated processing can be eliminated by substituting direct positive emulsions for the negative-working silver halide emulsions conventionally present in color reversal films. Unfortunately, direct positive emulsions are more difficult to manufacture, exhibit lower levels of sensitivity at comparable granularity, and have unique problems of their own, such as re-reversal, that have almost entirely foreclosed their use as replacements for negative-working emulsions.

Radiation-sensitive silver halide grains possess native sensitivity to the near ultraviolet region of the spectrum, and high bromide silver halide grains possess significant levels of blue sensitivity. Blue recording layer units often rely on the native sensitivity of the high bromide silver halide emulsions they contain for light capture. Blue recording layer units sometimes and green and red recording layer units always employ spectral sensitizing dyes adsorbed to silver halide grain surfaces to absorb light and to transfer exposure energy to the radiation-sensitive silver halide grains. In a simple textbook model the light absorbed in each of the blue, green and red recording layer units is limited to just that one region of the spectrum. For blue, green and red recording layer units light absorption in the blue (400 to 500 nm), green (500 to 600 nm) and red (600 to 700 nm) spectral region, respectively, is sought.

In practice each spectral sensitizing dye exhibits a peak (occasionally a dual peak) absorption wavelength and absorption declines progressively as exposure wavelengths diverge from the peak. Thus, considerable effort has gone into selecting spectral sensitizing dyes and dye combinations that best serve practical imaging needs.

The use of spectrally sensitized tabular grain emulsions in the minus blue recording layer units of color photographic elements has been demonstrated by Kofron et al U.S. Pat. No. 4,439,520 to improve image sharpness and to increase speed in relation to granularity. Kofron et al demonstrates that improvements in performance are realized as the average aspect ratios of the tabular grain emulsions are increased.

Kofron et al further discloses a variety of layer arrangements for color photographic elements having blue, green and red recording layer units, including arrangements containing two or more of each of green and red recording layer units differing in speed. Other illustrations of color photographic elements containing two or more green and/or red recording layer units are provided by *Research Disclosure,* Vol. 389, September 1996, Item 38957, XI. Layers and layer arrangements.

The green sensitivity of a multilayer film element is determined by the light absorption profile of the silver halide emulsions in the green sensitive layer unit attenuated by any light absorbing materials that lie above it in the top layers of the film, such as ultraviolet filter dyes, Lippmann emulsions, yellow filter layers, the blue sensitive emulsions, the yellow and magenta colored masking couplers in color negative films, and the optical properties of the red sensitive emulsions underneath the green record. The light absorption of the emulsions used in the green sensitive layer unit is in turn determined by the composite absorption of the specific combination of spectral sensitizing dyes adsorbed to the surface of the silver halide crystals, since silver halide emulsions only have native (intrinsic) sensitivity to blue light. Green sensitive emulsions used in the green recording layer unit that are commonly found in the art are observed to employ two or three green sensitizing dyes, and typically peak in dyed absorptance from about 530 nm to about 560 nm.

It has long been recognized that different light sources may require accommodation by the photographic system. For example, tungsten lighting sources emit substantially more light in the red-sensitive color band than in the blue-sensitive color band. Professional photographers have adapted to tungsten light in one of two ways. A daylight-balanced film, which is designed for a uniform (daylight) light source may be successfully used with tungsten lighting by fitting the camera with filters that remove some of the tungsten-lit scene's red and green light. This approach effectively "slows" the film speed and balances the light received by each layer, making the light look "uniformly spectrally distributed" to the film. Alternatively, a "tungsten" film, specifically designed to be used with tungsten light sources, may incorporate a faster blue layer and a slower red layer. This approach unbalances the speed of the film's layers to counteract the unbalance in the light source.

Amateurs photographing with tungsten illumination encounter varying results. With a daylight balanced reversal film, a tungsten-illuminated image takes on orangy-red hues. With a daylight balanced color negative film the tungsten-illuminated image yields an unbalance in the colors on the negative which may be accommodated by using filters during print-making to give a neutral print.

Fluorescent lights are quite different from tungsten in both design and quality of light. Fluorescent lights operate when an electric current passes through a tube filled with mercury gas. The excited mercury atoms emit visible and UV light. A strong visible emission from the mercury gas occurs at 545 nm, in the center of the color green. This emission gives fluorescent lights a greenish tinge, common to all fluorescent lights.

Designers of fluorescent lighting try to minimize the perception of the green emission by including phosphors, which absorb the UV and blue portion of the mercury emission and emit other colors. Among the "white" tubes commonly used for lighting many variations exist. "Cool white," for example, has more red than "Daylight" tubes. The variation in color is determined by the phosphors. But the quality of the visible emission of fluorescent lights is dominated by the green mercury emission at 545 nm.

It is possible that a film could be designed for fluorescent lighting by modifying and unbalancing the speeds of the film's layers to counteract the unbalance in the fluorescent light source. This approach could create a film specifically for fluorescent lighting, with altered speeds in the various color records. A film designed in this manner would be unbalanced for use in the uniform lighting unless coupled with a colored filter to make up for the unbalance.

Previous workers have tried to design green spectral sensitivities for color negative films for the purpose of reducing illuminant sensitivity. U.S. Pat. No. 3,672,898 describes a film with sensitivities designed to work with sunlight, tungsten, and fluorescent lighting. This film uses specific spectral sensitization in combination with ultraviolet, yellow, and magenta filter dyes. This film is complex to manufacture and does not yield saturated colors because of poor interimage correction.

U.S. Pat. No. 5,166,042 describes a color photographic film that is designed to have improved color reproduction under fluorescent lighting. The film features a spectral sensitivity such that the sensitivity measured with a monochromatic light source at 560 nm is such that the speed difference between the green and red recording units is in the range from −0.2 to 1.0. Most films have a larger speed separation at this wavelength. The difficulties with this approach are that much more green-red interimage correction would be required for a film with this characteristic, and this approach still does not address the problem of too much green speed and not enough blue speed.

U.S. Pat. No. 5,200,308 also describes color film spectral sensitivities designed to improve color reproduction under fluorescent illumination. The specified sensitivities increase the red and blue response of the film to fluorescent light sources, but the high green sensitivity of the film at the emission line of the fluorescent light source, limits the amount of improvement that can be achieved. U.S. Pat. No. 5,258,273 specifies a red spectral sensitivity of a multilayer color film structure. Color reproduction can be improved by increasing the short wavelength red response to better match the red phosphors used in fluorescent lights, but again the amount of improvement is limited because the green sensitivity is still higher than the red and blue under fluorescent illumination.

European Patent Applications 447 138 A1 and 458 315 A1 both describe green spectral sensitivities useful for photographs taken under fluorescent illumination. The sensitivity at 545 nm is reduced by shifting the peak sensitivity to a shorter or longer wavelength. However, the sensitivity has a single peak, and therefore, the aggregate green spectral sensitivity is not centered in the green region of the spectrum. Even though the green response of the film to fluorescent lighting is reduced, the shift of the overall green spectral sensitivity will have an undesirable effect on hue reproduction and the reproduction of skin colors.

U.S. Pat. Nos. 6,093,526 and 6,296,994 describe a preferred emulsion green absorptance and a preferred color film spectral sensitivity, respectively. These sensitivities are modeled after human eye sensitivities and should capture images with less sensitivity to illuminant changes. However, these sensitivities are intended for a film that is to be scanned and printed digitally. The high degree of overlap between the color records makes it impossible to achieve saturated colors with these spectral sensitivities when the film is printed by conventional optical printing methods.

U.S. Pat. No. 6,479,226 describes a green-sensitive element which gives a double peak, one in the 525 to 540 nm region and one in the 550 to 565 nm region. This method provides a broadened green-sensitive spectral envelope and is much like that of U.S. Pat. No. 5,053,324, and U.S. Pat. No. 5,308,748. Though these create maximum absorptions removed from the spiked green illuminant, none of these spectral envelopes sufficiently reduces absorption in the region of the 545 nm spike.

U.S. Pat. Nos. 4,705,744; 4,707,436, and 5,035,324 use a fourth, non-imaging layer with a spectral sensitivity between blue and green. This layer releases chemical inhibitors to adjust the response of imaging layers. The degree to which this happens depends on light distribution. This approach, as currently practiced, cannot adjust the film's response adequately over the whole tone scale, and probably suffers image structure degradation as a result of the presence of the fourth layer.

PROBLEM TO BE SOLVED BY THE INVENTION

In order to achieve accurate color reproduction under various illumination sources, the green-sensitive photographic element's sensitivity must meet certain requirements. The sensitivity must span an appropriate spectral bandwidth with continuous absorption to give the correct spectral response to photographic materials. This is accomplished with spectrally sensitive dyes adsorbed to silver halide emulsions. In common practice the dye or dyes used to accomplish this give a maximum absorption peak very near to the 545 nm emission line generated by some artificial illuminants. The proximity of the narrow artificial illuminant peak and the dye's maximum absorption peak result in an inappropriately strong response from the green layer and a consequent greenish or yellowish cast in photographs of objects partly or wholly illuminated by the artificial illuminant. Therefore, there is still a need to further improve the spectral sensitivity of color films to achieve balanced exposure under both daylight and fluorescent illumination while maintaining saturated, accurate color reproduction when a color negative film is printed by conventional optical methods, or when a color reversal film is to be viewed as a positive image.

SUMMARY OF THE INVENTION

This invention provides a silver halide photographic element comprising a support bearing a cyan dye image forming unit comprised of at least one red sensitive silver halide emulsion, a magenta dye image forming unit comprised of at least one green sensitive silver halide emulsion, and a yellow dye image forming unit comprised of at least one blue sensitive silver halide emulsion; wherein the at least one green sensitive silver halide emulsion comprises two absorptance peaks, the first peak being between 515 and 540 nm (short wavelength peak) and the second peak being between 565 and 590 nm, (long wavelength peak) and wherein (a) the ratio of the absorptance peak value of the short wavelength peak to the absorptance peak value of the long wavelength peak is from 0.65 to 1.55;

(b) the absorptance minimum between the two absorptance peaks is between 530 and 560 nm;

(c) the ratio of the absorptance value at the absorptance minimum to that of the smaller absorptance peak is 0.86 or less; and (d) the ratio of the absorptance at 490 nm to that of the highest absorptance peak is 0.60 or less.

The photographic elements of the invention accurately record a scene illuminated under different light sources. The elements exhibit a green spectral sensitivity sufficiently broad and well-shaped for effective color reproduction under natural lighting. The green spectral sensitivity is also sufficiently reduced at the 545 nm artificial illuminant peak to yield good color reproduction for objects partly or wholly illuminated by a broad range of artificial illuminants. The magenta sensitization described herein allows the creation of a balanced film, suitable for use with all illuminants, and does not suffer the image structure degradation resulting from fourth layer technology.

DETAILED DESCRIPTION OF THE INVENTION

The spectral sensitivity distribution of a silver halide emulsion is a representation of how the emulsion converts photons of absorbed light to developable latent image. It is conveniently displayed as a graph of photographic sensitivity (speed) versus wavelength of visible light. The light actually absorbed by a dyed emulsion in a gelatin coating on a support can be measured spectrophotometrically. Since silver halide crystals scatter light, some light is transmitted by the coating, some light is reflected, and the remainder is absorbed. The absorptance of a coating of a silver halide emulsion is determined by measuring wavelength-by-wavelength the total amount of light transmitted, and the total amount of light reflected. The absorptance at each wavelength is then expressed as (1-T-R) where T is the amount of light transmitted and R is the amount of light reflected. The absorptance is plotted as the percent of light absorbed versus the wavelength. Silver halide also absorbs blue light, especially as the halide is comprised of increasing concentrations of iodide. An absorptance spectrum for sensitizing dyes on silver halide can be obtained by subtracting, wavelength by wavelength, the absorptance spectrum of an undyed emulsion from that of the dyed emulsion, both coated on a transparent support at an equal coverage of silver. This technique is necessary in the blue light absorbing region of the visible spectrum, and is useful for emulsions dyed in the green region of the visible spectrum, especially when the silver halide emulsion exhibits absorptance in the short green region (<540 nm).

A combination of cyanine dyes on the surface of a silver halide emulsion is generally equally efficient at all wavelengths at converting absorbed photons to conduction band elections. Therefore, percent absorptance spectra can be used as a substitute for spectral sensitivity distribution.

In order to construct a film element with red, green and blue light recording layer units that can produce a photographic image that is less dependent on the illumination that was used during scene recording, it is necessary to use an emulsion in the green recording layer unit that has a combination of sensitizing dyes such that the green recording layer unit comprises at least one green sensitive emulsion, that when coated singly, has:

(i) two absorptance peaks, the first peak between 515 and 540 (short wavelength peak) nm and the second peak between 565 and 590 (long wavelength peak) nm;

(ii) the ratio of the absorptance peak value at the short wavelength peak to the absorptance peak value at the long wavelength peak is from 0.65 to 1.55;

(iii) the absorptance minimum between the two absorptance peaks is between 530 and 560 nm;

(iv) the ratio of the absorptance value at the minimum to that of the smaller absorptance peak is 0.86 or less; and (v) the ratio of the absorptance at 490 nm to that of the highest absorptance peak is 0.60 or less.

Preferably the short wavelength peak is between 515 and 535, and more preferably between 515 and 530, and the long wavelength peak is between 565 and 585, and more preferably between 565 and 580. In one embodiment of the photographic element the short wavelength peak is between 515 and 535, and the long wavelength peak is between 565 and 585. In another embodiment the short wavelength peak is between 515 and 530, and the long wavelength peak is between 565 and 580.

In a preferred embodiment the ratio of the absorptance peak value of the short wavelength peak to the absorptance peak value of the long wavelength peak is from 0.75 to 1.45. Also, preferably the absorptance minimum between the two absorptance peaks is between 535 and 555 nm, and more preferably the absorptance minimum between the two absorptance peaks is between 540 and 550 nm.

Preferably two or more sensitizing dyes are used in combination to provide the above spectral profile. Examples of employable sensitizing dyes include cyanine dyes, merocyanine dyes, complex cyanine dyes, holopolar cyanine dyes, hemicyanine dyes, styryl dyes, and hemioxonol dyes. Particularly preferred are cyanine dyes having the general formula I shown below.

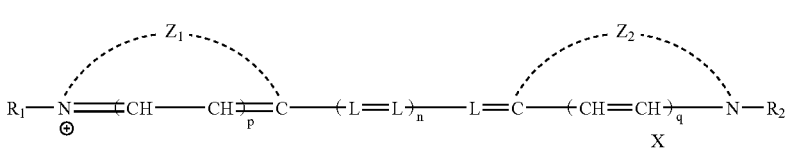

(I)

wherein each of $R_1$ and $R_2$ independently represents a substituted or unsubstituted alkyl group, preferably containing 1 to 10 carbon atoms, or substituted or unsubstituted aryl group; each of $Z_1$ and $Z_2$ independently represents the atoms necessary to complete a 5- or 6-membered heterocyclic ring system; each L is a substituted or unsubstituted methine group; each of p, q, and n is independently 0 or 1; and X is a counterion as necessary to balance the charge.

Preferred dyes are represented by Formula II shown below:

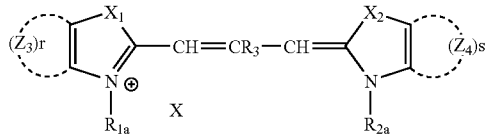

(II)

$R_{1a}$, $R_{2a}$, independently represents a substituted or unsubstituted alkyl group, preferably containing 1 to 10 carbon atoms, or substituted or unsubstituted aryl group. X has the same meaning as in Formula I, and each of r and s is independently 0 or 1. $Z_3$ and $Z_4$ independently represents the atoms necessary to complete a fused benzene, naphthalene, pyridine, or pyrazine ring, which can be further substituted. $R_3$ is a substituted or unsubstituted alkyl group, preferably containing 1–6 carbon atoms, or a substituted or unsubstituted aryl group. $X_1$ and $X_2$ can each individually be O, S, Se, or N—$R_4$, wherein $R_4$ is a substituted or unsubstituted alkyl group, preferably containing 1 to 10 carbon atoms, or a substituted or unsubstituted aryl group, with the proviso that $X_1$ and $X_2$ are not both S or Se. When r or s is 0, the 5-membered ring containing $X_1$ or $X_2$, respectively, may be further substituted at the 4 and/or 5 position.

Preferred dyes of formula II are those where $X_1$ and $X_2$ are O, S, Se, or N—$R_4$. It is also preferred that one or both of r and s is equal to 1, and that at least one of $R_{1a}$ and $R_{2a}$ contains an acid solubilizing group. It will be recognized by those skilled in the art that as $X_1$ and $X_2$ are changed from O to N—$R_4$ to S, to Se, the dyes will absorb light at longer wavelengths. Therefore, it is anticipated that a mixture of dyes used in the practice of this invention will typically utilize two or more carbocyanine dyes with a range of values for $X_1$ and $X_2$.

Cyanine spectral sensitizing dyes that form J-aggregates are preferred for building the needed breadth of absorption with good quantum efficiency on silver halide emulsions of the invention; J-aggregating carbocyanine dyes are the most preferred dyes for the practice of this invention.

In order to achieve adequate sensitivity at wavelengths <540 nm, the "short green" region of the spectrum, and still maintain a high sensitivity of the silver halide, it is further preferred that a J-aggregating "short wavelength" green sensitizing dye be employed in the invention. Examples of J-aggregating short green sensitizing dyes are described by, but not limited to, the following general structures SG-I to SG-IV:

SG-I

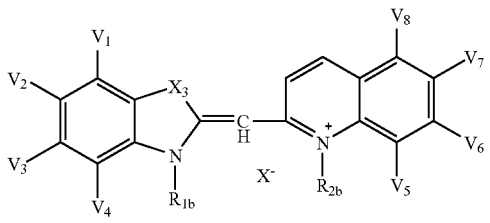

wherein $R_{1b}$, $R_{2b}$ independently represents a substituted or unsubstituted alkyl group, preferably containing 1 to 10 carbon atoms, or a substituted or unsubstituted aryl group. X has the same meaning as in Formula I. $X_3$ is S or Se, and each of $V_1$ to $V_8$ independently represents hydrogen, a substituted or unsubstituted alkyl group, a substituted or unsubstituted aromatic group, a halogen atom, a cyano group, a sulfamyl, an alkoxycarbonyl , an acylamino group, a carbamoyl group, a carboxy group, or a substituted or unsubstituted alkoxy group and adjacent pairs of substituents $V_1$ to $V_7$ may be joined to form a fused carbocyclic, heterocyclic, aromatic, or heteroaromatic ring, which may be substituted.

SG-II

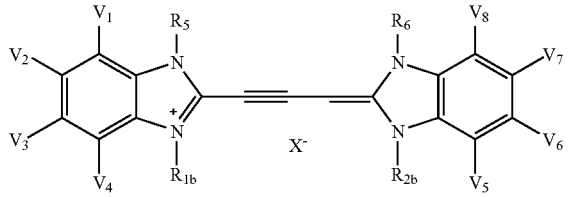

wherein $R_{1b}$, $R_{2b}$, X, and $V_1$–$V_8$ have the same meaning as in SG-I; and each of $R_5$ and $R_6$ independently represents a substituted or unsubstituted alkyl group, preferably containing 1 to 10 carbon atoms, or a substituted or unsubstituted aryl group.

SG-III

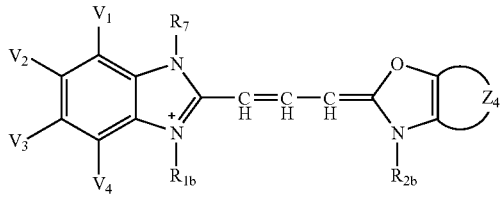

wherein $R_{1b}$, $R_{2b}$, $V_1$–$V_4$ and X have the same meaning as in formula SG-I; $Z_4$ represents the atoms necessary to complete a fused benzene, naphthalene, pyridine, or pyrazine ring, which can be further substituted; and $R_7$ represents a substituted or unsubstituted alkyl group, preferably containing 1 to 10 carbon atoms, or a substituted or unsubstituted aryl group. Dyes of type SG-III are benzimidazolooxacarbocyanines or benzimidazolooxazolocarbocyanines and in order to achieve a J-aggregate that absorbs light at a short green wavelength, it is necessary to make the chromophore very unsymmetrical with respect to the charge distribution. This is accomplished by incorporating electron withdrawing substituents into the oxazole or benzoxazole ring. An example of electron withdrawing groups for $R_{2b}$ are fluoro substituted alkyl groups. Examples of electron withdrawing substituents on $Z_4$ are trifluoromethyl and cyano.

SG-IV

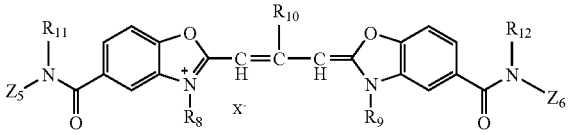

wherein $R_{10}$ is hydrogen or a substituted or unsubstituted aryl group (e.g., phenyl) or more preferably a substituted or unsubstituted alkyl group (e.g., lower alkyl having 1 to 4 carbon atoms, such as methyl, ethyl, etc.). $R_8$ and $R_9$ are both independently substituted or unsubstituted alkyl groups; for example, both may be 1–8 carbon alkyl groups, and may be the same or different; at least one of $R_8$ or $R_9$ is preferably substituted by an acid or acid salt group, and preferably both $R_8$ and $R_9$ may be substituted by an acid or acid salt group (particularly preferred acid salt groups are carboxy and sulfo groups, for example, 3-sulfobutyl, 4-sulfobutyl, 3-sulfopropyl, 2-sulfoethyl, carboxyethyl, carboxypropyl, and the like). $R_{11}$ and $R_{12}$ is independently hydrogen or a substituted or unsubstituted alkyl group (such as a methyl or ethyl group). $Z_5$ and $Z_6$ each individually represents a substituted or unsubstituted aromatic group, and X is one or more ions needed to balance the charge on the molecule.

The $Z_5$ and $Z_6$ aromatic groups can be hydrocarbon or heterocyclic (The definition of aromatic rings is described in J. March *Advanced Organic Chemistry,* Chapter 2, (1985), John Wiley & Sons, New York). Examples of $Z_5$ and $Z_6$ include a substituted or unsubstituted phenyl group, substituted or unsubstituted thiophene-3-yl group, etc. Preferred examples of J-aggregating short green dyes are those of formula SG-IV.

Non-limiting examples of J-aggregating short green dyes which may be used in the practice of this invention are as follows (in these structures Me stands for CH3 and Et stands for CH3-CH2-:

SD-1

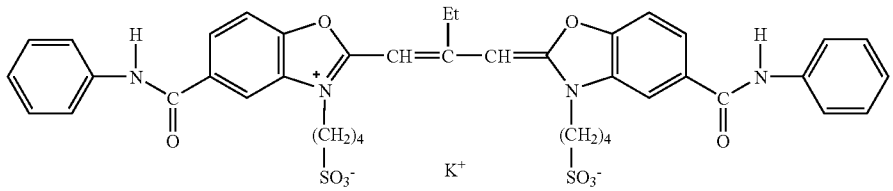

SD-2

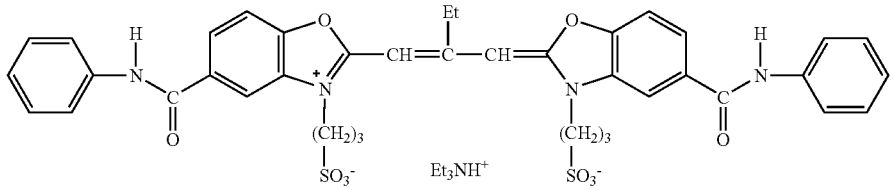

SD-3

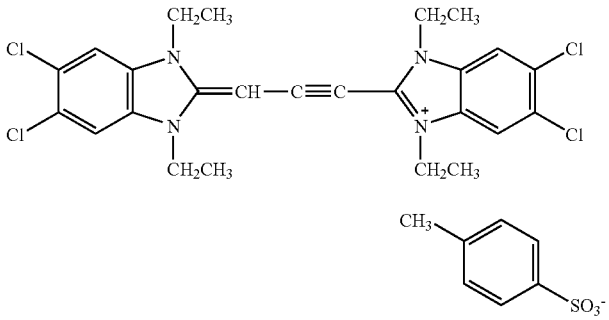

SD-4

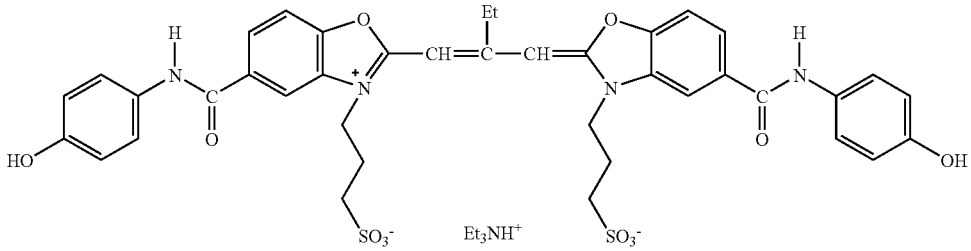

SD-5

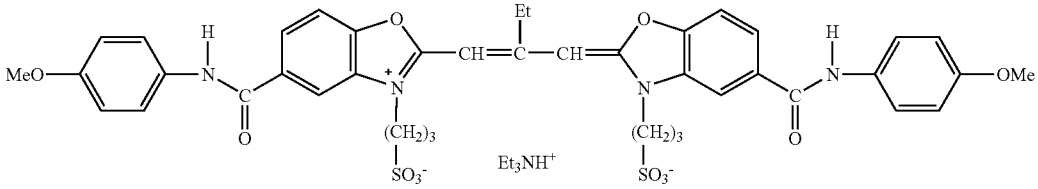

-continued
SD-6
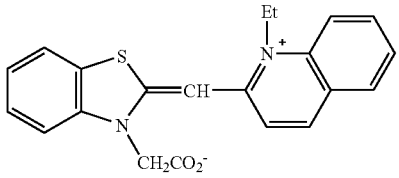
SD-7
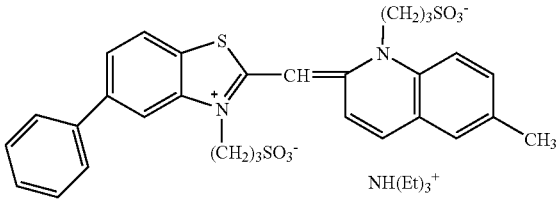
SD-8
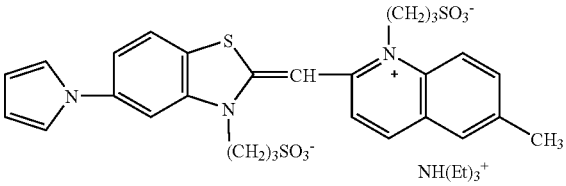
SD-9
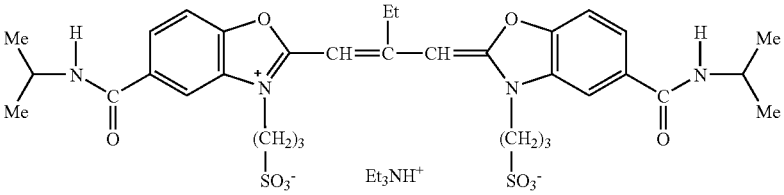
SD-10
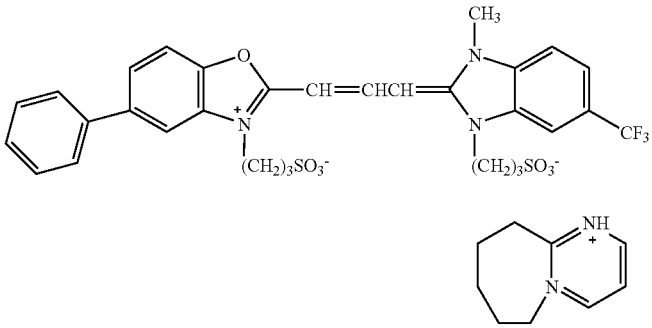
SD-11
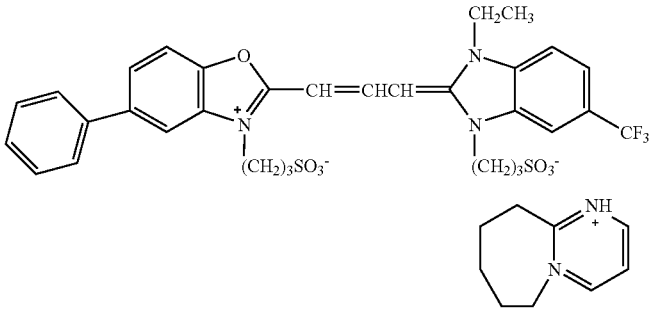

-continued
SD-12
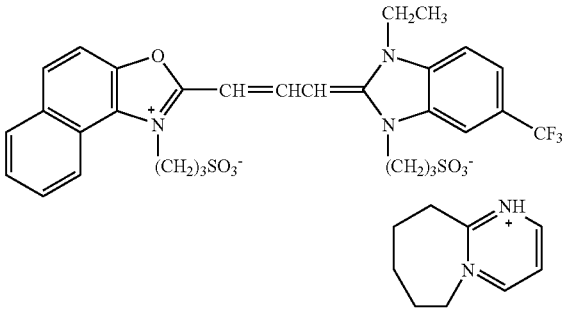
SD-13
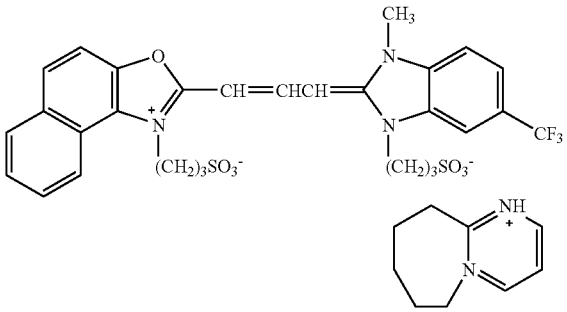
SD-14
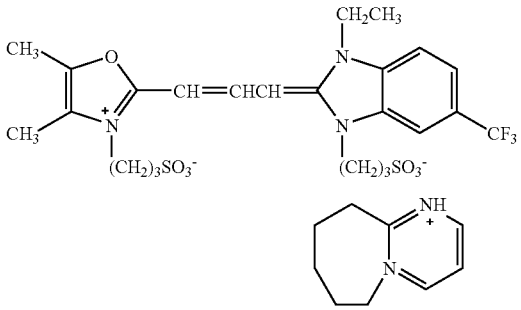
SD-15
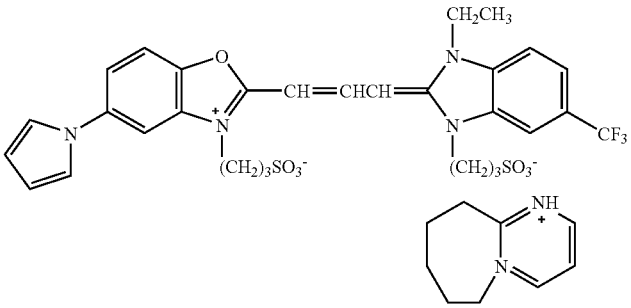
SD-16
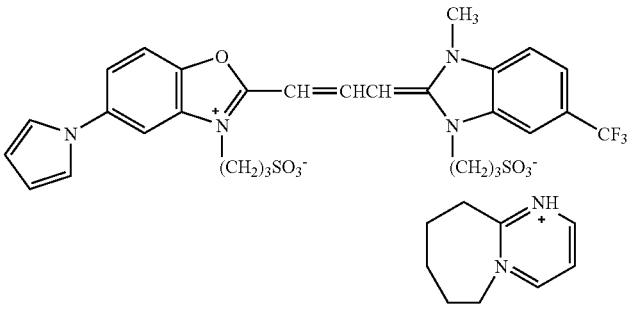

-continued

SD-17

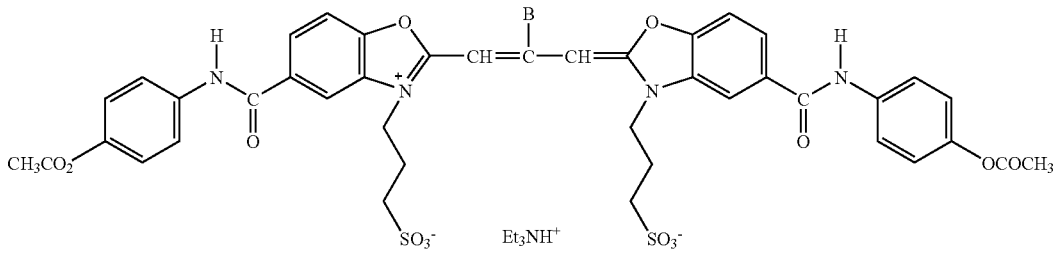

The green sensitive silver halide emulsion may be sensitized by sensitizing dyes using any method known in the art. Dyes may be added to the silver halide emulsion singly or together. A preferred method of addition of the dyes to the silver halide is by premixing them as a solution in a suitable solvent, as a mixed dispersion in aqueous gelatin, or as a mixed liquid crystalline dispersion in water. Of course, green sensitized silver halide emulsions will be sensitized in accord with the requirements as described. The dye or dyes may be added to the silver halide emulsion grains and hydrophilic colloid at any time prior to or simultaneous with the application of a liquid coating solution comprised of the emulsion to a support. The sensitizing dye or dyes may be added prior to, during, or following the chemical sensitization of the emulsion grains. With tabular silver halide emulsions, the dyes are preferably added to the grains before chemical sensitization.

Two or more sensitizing dyes are typically used to achieve the objectives of the invention. A combination of dyes is useful also for supersensitization as well as spectral response adjustment. Since the spectral absorption characteristics of a sensitizing dye on an emulsion will, to some extent, bear on the particular emulsion used as well as the other sensitizing dyes present on the same emulsion, the sensitizing dyes selected to sensitize the green light recording silver halide emulsion to within the required characteristics of the invention will be chosen with these characteristics in mind. Furthermore, other factors such as the order of addition, the silver ion potential (vAg), the emulsion surface and its halide type can be manipulated to achieve the desired spectral absorptances.

It is contemplated that use of dye layering such as described in U.S. Pat. Nos. 6,620,581; 6,361,932 and 6,331,385 incorporated herein by reference would be particularly useful for practicing this invention.

The light sensitive silver halide emulsion of the instant invention may contain a compound which is a dye having no spectral sensitization effect itself, or a compound substantially incapable of absorbing visible light in the spectral regions according to the invention, or which does absorb light in the spectral region of interest but is present in very low quantities but which exhibits a supersensitizing effect, such as compounds described in U.S. Pat. No. 3,615,641, or as disclosed in *Research Disclosure*, Vol. 389, September 1996, Item 38957.

In another embodiment of the invention, the silver halide emulsion comprises multiple layers of sensitizing dyes adsorbed to the silver halide surface. U.S. Pat. Nos. 6,165,703 and 6.361,932 disclose emulsions sensitized with two or more dyes which form layers on the silver halide grains exhibit increased the light absorption.

Illustrations of useful spectral sensitizing dyes and techniques are provided by *Research Disclosure,* Item 38957, cited above, section V. Spectral sensitization and desensitization. More concrete examples of sensitizing dyes are disclosed, for example, in U.S. Pat. Nos. 4,617,257; 5,037,728; 5,166,042; and 5,180,657.

(Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including a straight- or branched-chain or cyclic alkyl, such as methyl, trifluoromethyl, ethyl, t-butyl, and; alkenyl, such as ethylene, 2-butene; alkoxy, such as methoxy, ethoxy, propoxy, butoxy, 2-methoxyethoxy, sec-butoxy, hexyloxy, 2-ethylhexyloxy, and; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, 2-oxo-pyrrolidin-1-yl, N-succinimido, N-phthalimido, 2,5-dioxo-1-oxazolidinyl, and ethoxycarbonylamino, phenoxycarbonylamino, benzyloxycarbonylamino, phenylcarbonylamino, p-tolylcarbonylamino, N-methylureido, N,N-dimethylureido, N-phenylureido, and t-butylcarbonamido; sulfonamido, such as methylsulfonamido, benzenesulfonamido, p-tolylsulfonamido, N,N-dipropyl-sulfamoylamino, sulfamoyl, such as N-methylsulfamoyl, N-ethylsulfamoyl, N,N-dipropylsulfamoyl, N,N-dimethylsulfamoyl; carbamoyl, such as N-methylcarbamoyl, N,N-dibutylcarbamoyl, ; acyl, such as acetyl, phenoxycarbonyl, methoxycarbonyl, butoxycarbonyl, , ethoxycarbonyl, benzyloxycarbonyl,; sulfonyl, such as methoxysulfonyl, , phenoxysulfonyl, , methylsulfonyl, 1, phenylsulfonyl, and p-tolylsulfonyl; sulfinyl, such as methylsulfinyl, phenylsulfinyl, and p-tolylsulfinyl; thio, such as ethylthio, and p-tolylthio; acyloxy, such as acetyloxy, benzoyloxy, N-phenylcarbamoyloxy, N-ethylcarbamoyloxy, and cyclohexylcarbonyloxy; amine, such as phenylanilino, 2-chloroanilino, diethylamine, imino, such as, N-succinimido or 3-benzylhydantoinyl; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl;

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 10 carbon atoms, typically 1 to 8 carbon atoms and usually less than 7 carbon atoms, but greater numbers are possible depending on the particular substituents selected.

When the term "associated" is employed, it signifies that a reactive compound is in or adjacent to a specified layer where, during processing, it is capable of reacting with other components.

The elements of the invention are multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure,* September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as U.S. Pat. Nos. 2,367,531; 2,423,730; 2,474,293; 2,772,162; 2,895,826; 3,002,836; 3,034,892; 3,041,236; 4,333,999; 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos.

2,298,443; 2,407,210; 2,875,057; 3,048,194; 3,265,506; 3,447,928; 4,022,620; 4,443,536; and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; and U.S. Pat. Nos. 3,632,345; 3,928,041; 3,958,993; and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213 490; Japanese Published Application 58-172,647; U.S. Pat. Nos. 2,983,608 and 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193 389; EP 301 477; and U.S. Pat. Nos. 4,163,669; 4,865,956; and 4,923,784 may be useful. Also contemplated is use of the compositions in association with nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323 and EP 96 570.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

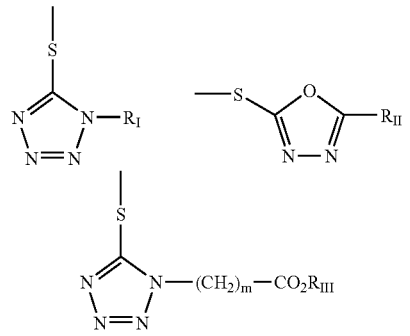

-continued

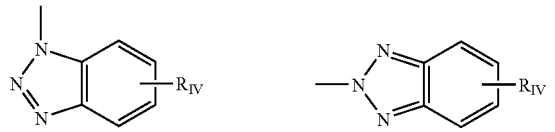

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; and 4,861,701, Japanese Applications 57-188035; 58-98728; 58-209736; 58-209738); groups that function as a coupler or reducing agent after the coupler reaction (U.S. Pat. Nos. 4,438,193 and 4,618,571) and groups that combine the features describe above. It is typical that the timing group is of one of the formulas:

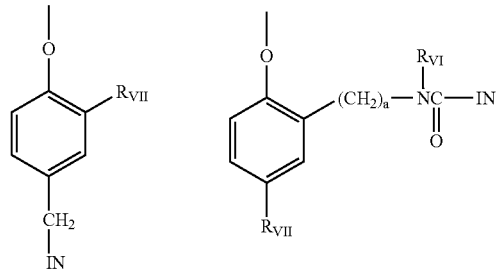

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

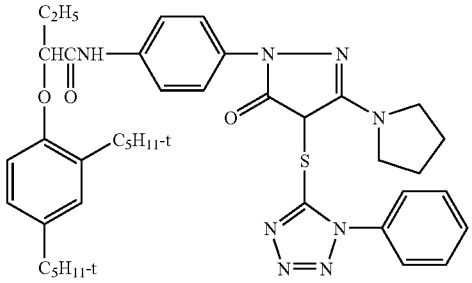

D2

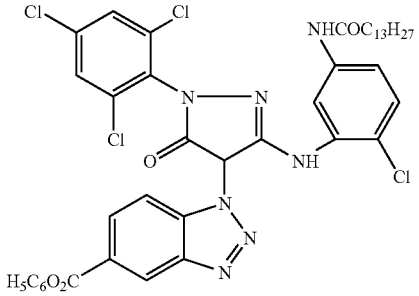

D3

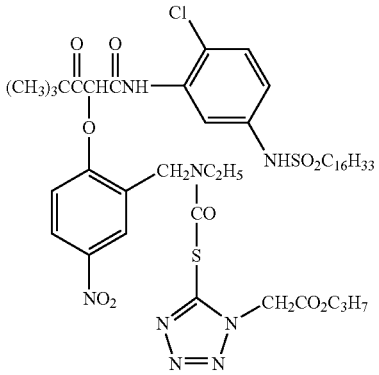

D4

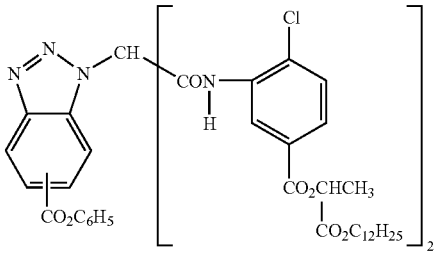

-continued
D5
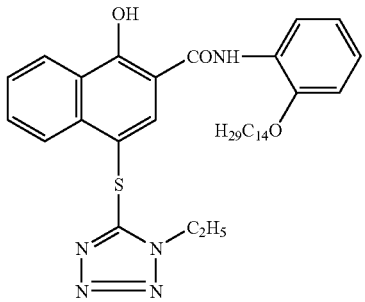
D6
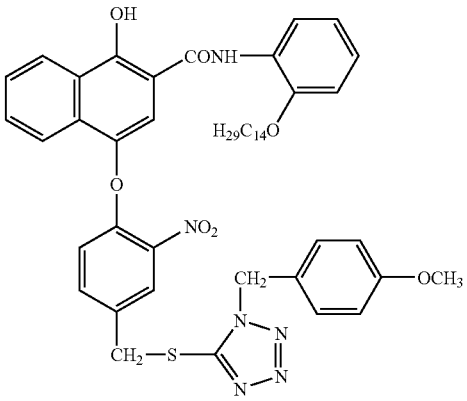
D7
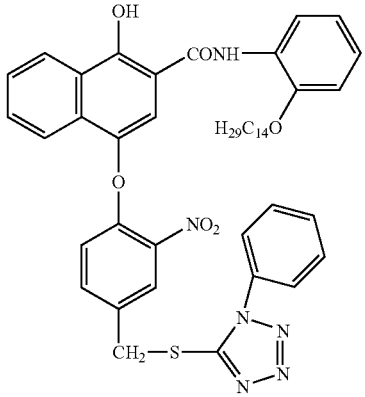
D8
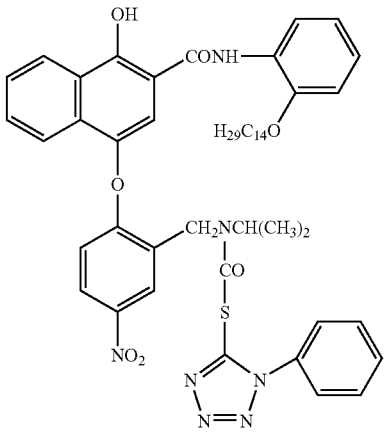
-continued
D9
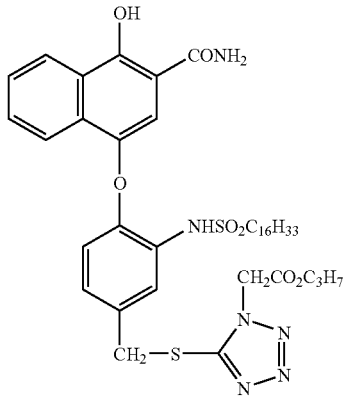
D10
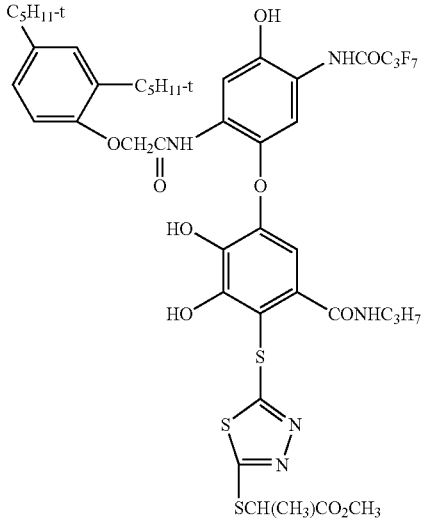
D11
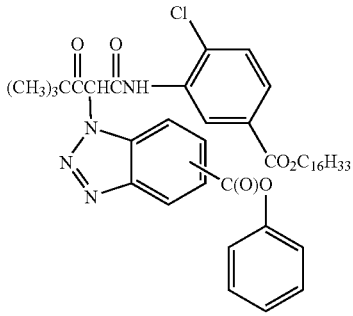
D12
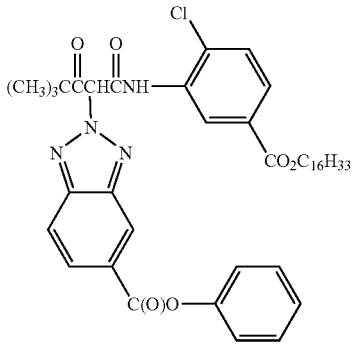

The silver halide used in the photographic elements may be silver iodobromide, silver bromide, silver chloride, silver chlorobromide, silver chloroiodobromide, and the like. High bromide emulsions are preferred, especially iodobromide emulsions. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337; 5,292,632; 5,275,930; 5,607,828; and 5,399,477; House et al U.S. Pat. No. 5,320,938; Brust et al U.S. Pat. No. 5,314,798; Szajewski et al U.S. Pat. No. 5,356,764; Chang et al U.S. Pat. Nos. 5,413,904; 5,663,041; and 5,744,297; Budz et al U.S. Pat. No. 5,451,490; Reed et al U.S. Pat. No. 5,695,922; Oyamada U.S. Pat. No. 5,593,821; Yamashita et al U.S. Pat. Nos. 5,641,620 and 5,652,088, Saitou et al U.S. Pat. No. 5,652,089 and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide { 111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; 4,173,320; and 5,411,851; 5,418,125; 5,492,801; 5,604,085; 5,620,840; 5,693,459; 5,733,718; Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771; '5,147,772; 5,147,773; 5,171,659; and 5,252,453; Black et al U.S. Pat. Nos. 5,219,720 and 5,334,495, Delton U.S. Pat. Nos. 5,310,644; 5,372,927; and 5,460,934; Wen U.S. Pat. No. 5,470,698; Fenton et al U.S. Pat. No. 5,476,760; Eshelman et al U.S. Pat. Nos. 5,612,175; 5,612,176; and 5,614,359; and Irving et al U.S. Pat. Nos. 5,695,923; 5,728,515; and 5,667,954; Bell et al U.S. Pat. No. 5,132,203; Brust U.S. Pat. Nos. 5,248,587 and 5,763,151, Chaffee et al U.S. Pat. No. 5,358,840; Deaton et al U.S. Pat. No. 5,726,007; King et al U.S. Pat. No. 5,518,872; Levy et al U.S. Pat. No. 5,612,177; Mignot et al U.S. Pat. No. 5,484,697; Olm et al U.S. Pat. No. 5,576,172; and Reed et al U.S. Pat. Nos. 5,604,086 and 5,698,387.

Ultrathin high bromide {111} tabular grain emulsions are illustrated by Daubendiek et al U.S. Pat. Nos. 4,672,027; 4,693,964; 5,494,789; 5,503,971; and 5,576,168, Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al, and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al U.S. Pat. No. 4,937,180; and Johnson et al U.S. Pat. No. 5,164,292. In addition, it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure,* Item 36736, published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention:

EXAMPLES

The invention can be better appreciated by reference to the following specific embodiments. All coating coverages are reported in parentheses in terms of $g/m^2$, except as otherwise indicated. Silver halide coating coverages are reported in terms of silver.

Glossary of Acronyms

HBS-2 Di-n-butyl phthalate

TAI 5-Methyl-1,2,4-triazolo[1,5-a]pyrimidin-7-ol

H-1 Bis(vinylsulfonyl)methane

C-1

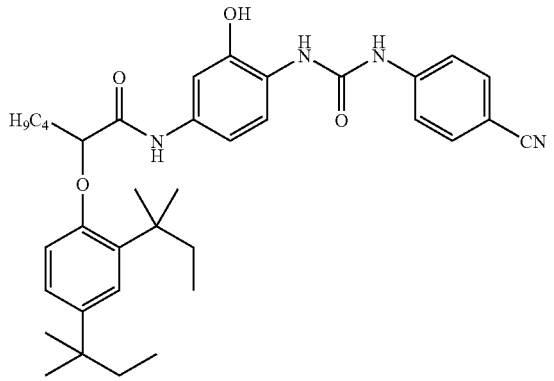

-continued
SSD-1
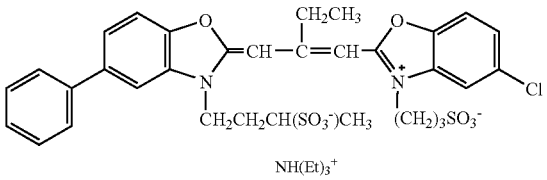
SSD-2
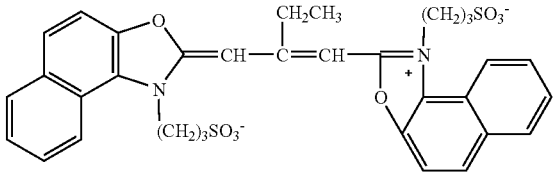
SSD-3
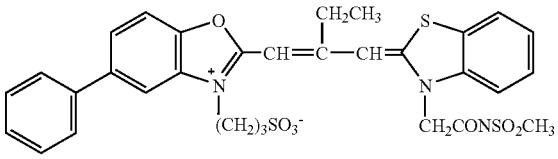
SSD-4
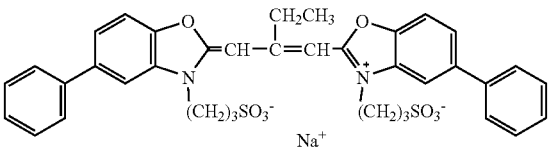
SSD-5
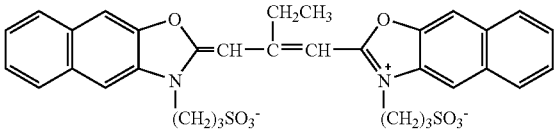
SSD-6
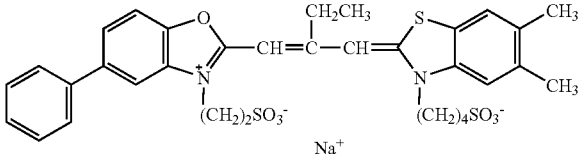
SSD-7
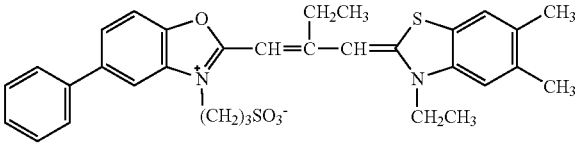
-continued
SSD-8
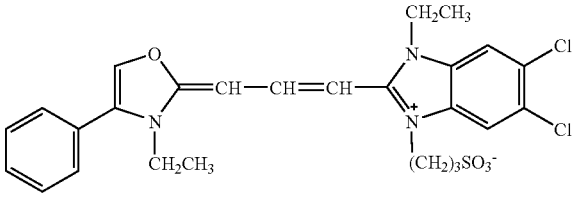
SSD-9
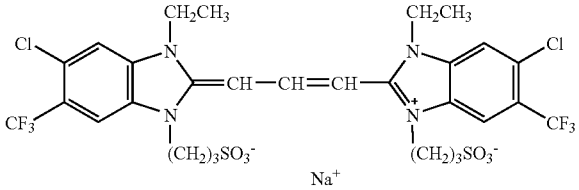
SSD-10
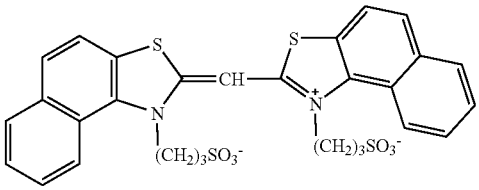
SSD-11
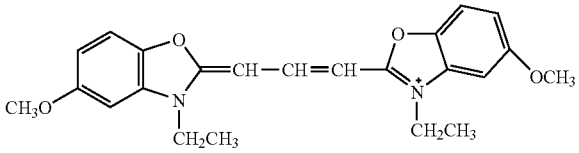
SSD-12
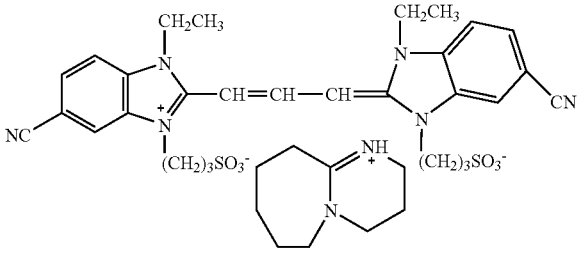
SSD-13
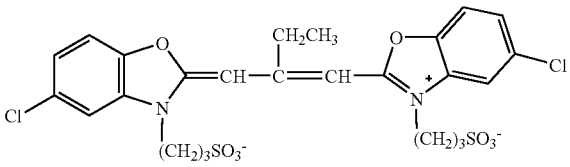

-continued

SSD-14

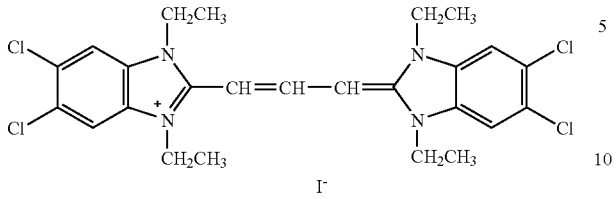

SSD-15

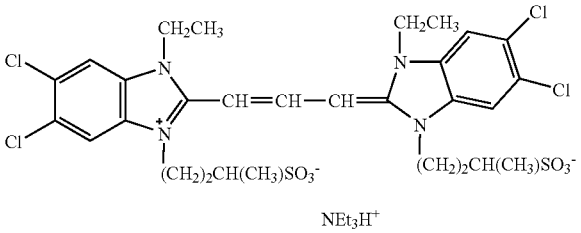

SSD-16

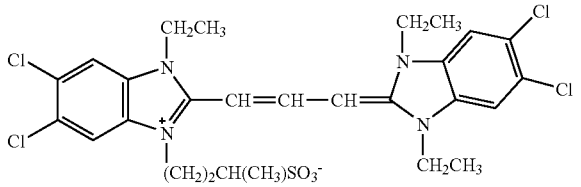

SSD-17

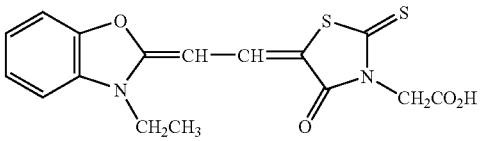

SSD-18

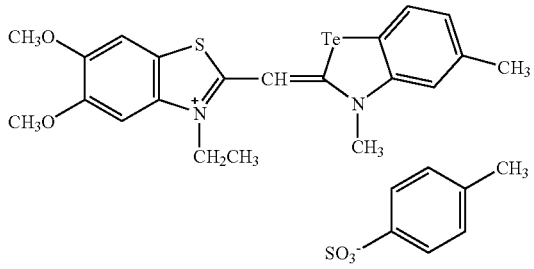

-continued

SSD-19

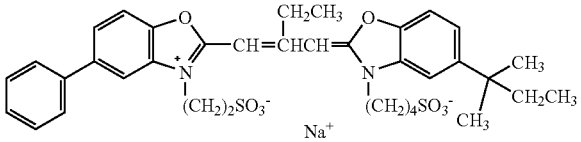

Example I

Component Properties

Photographic samples 101 through 158 were prepared. For all samples, emulsion A, with an iodide content of 3.8 mole percent, based on silver, was used. The mean equivalent circular diameter of the emulsion was 2.5 μm, the average thickness of the tabular grains was 0.12 μm, and the average aspect ratio of the tabular grains was 20.8. Tabular grains accounted for greater than 90% of the total grain projected area.

Emulsion A was sensitized using sodium thiocyanate at 120 mg/mole of silver, 0.90 mmole of spectral sensitizing dye per mole of silver, sodium aurous(I) dithiosulfate dihydrate at 2.2 mg/mole of silver, sodium thiosulfate pentahydrate at 1.1 mg/mole of silver, and 3-(N-methylsulfonyl) carbamoyl-ethylbenzothiazolium tetrafluoroborate at 45 mg/mole of silver. Following the chemical additions the emulsion was subjected to a heat treatment at 62.5° C. for 20 minutes as is common in the art.

Sensitizing dyes used for the spectral sensitization are given in Table 1-1. The multiple dye sensitizations were accomplished by either adding the dyes simultaneously, adding dyes as two separate additions of two dye mixtures (sets of dyes added together are given in parentheses), or by adding each dye separately, in the order shown. Mixture dye additions were accomplished by simultaneously adding the dyes to the emulsion during sensitization, and the dyes were first co-dissolved in methanol solution prior to addition to the emulsion or co-dissolved in a water and gelatin mixture prior to addition to the emulsion.

TABLE 1-1

| Sample Number (Inventive/ Comparative) | Method of Dye Addition | Dyes Used | Mole Ratio of Dye Component |
|---|---|---|---|
| 101 (Inv) | Separately | SD-2/SSD-9 | 50/50 |
| 102 (Inv) | Separately | SD-3/SSD-9 | 50/50 |
| 103 (Comp) | One dye alone/ (two dyes mixed) | SD-2/(SSD-1 SSD-9) | 20/(30 50) |
| 104 (Inv) | One dye alone/ (three dyes mixed) | SD-2/(SSD-1 SSD-9 SSD-3) | 20/(20 35 25) |
| 105 (Inv) | One dye alone/ (three dyes mixed) | SD-2/(SSD-1 SSD-9 SSD-3) | 30/(5 30 35) |
| 106 (Inv) | One dye alone/ (two dyes mixed) | SD-2/(SSD-9 SSD-3) | 20/(40 40) |

TABLE 1-1-continued

| Sample Number (Inventive/ Comparative) | Method of Dye Addition | Dyes Used | Mole Ratio of Dye Component |
|---|---|---|---|
| 107 (Inv) | One dye alone/ (two dyes mixed) | SD-2/(SSD-9 SSD-3) | 20/(20 60) |
| 108 (Inv) | One dye alone/ (two dyes mixed | SD-3/(SSD-1 SSD-3) | 50/(25 25) |
| 109 (Inv) | One dye alone/ (two dyes mixed) | SD-2/(SSD-1 SSD-3) | 20/(40 40) |
| 110 (Inv) | One dye alone/ (two dyes mixed) | SD-2/(SSD-1 SSD-3) | 30/(20 50) |
| 111 (Comp) | Separately | SD-2/SSD-9 | 25/75 |
| 112 (Comp) | Separately | SD-7/SSD-9 | 50/50 |
| 113 (Comp) | Separately | SD-2/SSD-9 | 75/25 |
| 114 (Comp) | One dye alone/ (two dyes mixed) | SD-2/(SSD-1 SSD-9) | 10/(60 30) |
| 115 (Comp) | One dye alone/ (two dyes mixed) | SD-2/(SSD-1 SSD-9) | 20/(45 35) |
| 116 (Comp) | Mixed | (SD-2 SSD-1 SSD-9) | (20 10 70) |
| 117 (Comp) | Mixed | (SD-2 SSD-1 SSD-9 SSD-3) | (25 48.4 15 11.6) |
| 118 (Comp) | Separately | SD-2/SSD-1 | 50/50 |
| 119 (Comp) | Separately | SD-2/SSD-3 | 50/50 |
| 120 (Comp) | Separately | SSD-1/SSD-9 | 75/25 |
| 121 (Comp) | Separately | SSD-9/SSD-3 | 50/50 |
| 122 (Comp) | One dye alone/ (two dyes mixed) | SD-2/(SSD-9 SSD-3) | 10/(60 30) |
| 123 (Comp) | One dye alone/ (two dyes mixed) | SD-2/(SSD-9 SSD-3) | 50/(30 20) |
| 124 (Comp) | One dye alone/ (two dyes mixed) | SD-3/(SSD-9 SSD-3) | 20/(40 40) |
| 125 (Comp) | One dye alone/ (two dyes mixed) | SD-7/(SSD-9 SSD-3) | 20/(40 40) |
| 126 (Comp) | One dye alone/ (two dyes mixed) | SD-2/(SSD-1 SSD-3) | 50/(25 25) |
| 127 (Comp) | One dye alone/ (two dyes mixed) | SD-7/(SSD-1 SSD-3) | 50/(25 25) |
| 128 (Comp) | One dye alone/ (two dyes mixed) | SD-2/(SSD-1 SSD-3) | 11.12/(44.4 44.4) |
| 129 (Comp) | One dye alone/ (two dyes mixed) | SD-2/(SSD-1 SSD-3) | 14.3/(57.1 28.6) |
| 130 (Comp) | Separately | SD-2/SSD-1/SSD-9/SSD-3 | 30/40/17/13 |
| 131 (Comp) | Two dyes mixed/ two dyes mixed | (SD-3 SSD-1)/(SSD-2 SSD-3) | (39.4 39.4)/(13.4 7.8) |
| 132 (Comp) | Mixed | SD-1 SSD-1 SSD-2 SSD-3 | 15 50 20 15 |
| 133 (Comp) | Mixed | SD-1 SSD-1 SSD-2 SSD-3 | 20 50 20 10 |
| 134 (Comp) | Mixed | SSD-17 SSD-1 SSD-18 | 25 45 30 |
| 135 (Comp) | Mixed | SSD-2 SSD-13 | 65 35 |
| 136 (Comp) | Alone | SSD-19 | 100 |
| 137 (Comp) | Mixed | SSD-9 SSD-1 | 25 75 |
| 138 (Comp) | Mixed | SSD-19 SSD-1 | 71.4 28.6 |
| 139 (Comp) | Mixed | SSD-4 SSD-15 | 67 33 |
| 140 (Comp) | Mixed | SSD-4 SSD-5 | 65 35 |
| 141 (Comp) | Mixed | SSD-6 SSD-1 | 16.7 83.3 |
| 142 (Comp) | Mixed | SSD-7 SSD-5 SSD-1 | 6 20 74 |
| 143 (Comp) | Mixed | SSD-8 SSD-1 SSD-7 | 42.9 42.9 14.2 |
| 144 (Comp) | Mixed | SSD-19 SSD-1 SSD-7 | 55.6 33.3 11.1 |
| 145 (Comp) | Mixed | SSD-19 SSD-1 SSD-7 | 68.6 28.6 2.8 |
| 146 (Comp) | Mixed | SSD-10 SSD-1 SSD-7 | 62.9 28.6 8.5 |
| 147 (Comp) | Mixed | SSD-19 SSD-1 SSD-7 | 62.9 28.6 8.5 |
| 148 (Comp) | Mixed | SSD-19 SSD-6 | 83.3 16.7 |
| 149 (Comp) | Mixed | SSD-19 SSD-7 | 83.3 16.7 |
| 150 (Comp) | Mixed | SSD-19 SSD-1 SSD-7 | 20 70 10 |
| 151 (Comp) | Mixed | SSD-1 SSD-7 SSD-5 | 80 15.4 4.6 |
| 152 (Comp) | Mixed | SSD-4 SSD-11 | 33 67 |
| 153 (Comp) | Mixed | SSD-12 SSD-4 SSD-5 SSD-13 | 8.1 50.4 40.3 1.2 |
| 154 (Comp) | Mixed | SSD-5 SSD-4 SD-6 | 12.5 62.5 25 |
| 155 (Comp) | Mixed | SSD-13 SSD-14 | 83 17 |
| 156 (Comp) | Mixed | SSD-13 SSD-15 SSD-1 | 65.8 21 13.2 |
| 157 (Comp) | Mixed | SSD-1 SSD-15 SSD-7 | 68.5 27.4 4.1 |
| 158 (Comp) | Mixed | SSD-1 SSD-15 SSD-7 SSD-16 | 27.8 27.8 2.8 41.6 |

A transparent film support of cellulose triacetate with conventional subbing layers was provided for coating. The side of the support to be emulsion coated received an undercoat layer of gelatin (4.9). The reverse side of the support was comprised of dispersed carbon pigment in a non-gelatin binder (Rem Jet).

The coatings were prepared by applying the following layers in the sequence set out below to the support. Hardener H-1 was included at the time of the coating at 1.80 percent by weight of total gelatin, including the undercoat, but excluding the previously hardened gelatin subbing layer forming a part of the support. Surfactant was also added to the various layers as is commonly practiced in the art.

| Layer 1: Light-Sensitive Layer | |
|---|---|
| Sensitized Emulsion silver | (1.08) |
| Cyan dye forming coupler C-1 | (0.97) |
| HBS-2 | (0.97) |
| Gelatin | (3.23) |
| TAI | (0.017) |
| **Layer 2: Gelatin Overcoat** | |
| Gelatin | (4.30) |

The dispersed carbon pigment on the back of the coating was removed with methanol. The light transmittance and reflectance of the sample was measured using a spectrophotometer over the visible light range (360 to 700 nanometers) at two nanometer wavelength increments. The total reflectance (R) is the fraction of light reflected from the coating, measured with an integrating sphere which includes all light exiting the coating regardless of angle. The total transmittance (T) is the fraction of light transmitted through the coating regardless of angle. The total absorptance (A) of the coating is determined from the measured total reflectance and total transmittance using the equation A=1-T-R.

These data represent the absorption of the sensitizing dyes as adsorbed onto the grain surface as well as the intrinsic absorption of the silver halide emulsion. In order to separate the intrinsic absorption of the emulsion from the absorption due to the spectral sensitizing dye, coatings were prepared and evaluated as for this example of the unsensitized emulsion. The intrinsic absorption from these coatings was subtracted from the coatings (samples 101 through 158) containing sensitizing dye.

The wavelength of the absorptance peak or peaks and the absorptance minimum in the green region were then determined from the sensitizing dye absorptance data. These data are tabulated in Table 1-2. The ratio of the absorptance of the short wavelength peak to the long wavelength peak was calculated from the sensitizing dye absorptance data and tabulated in Table 1-2. The ratio of the absorptance at the minimum to the absorptance of the smaller of the peaks was calculated, and the ratio of the absorptance at 490 nm to the absorptance of the highest peak was calculated. Both ratios were calculated based on the sensitizing dye absorptance data and are tabulated in Table 1-2. If the sensitizing dye absorptance exhibited only one absorptance maximum, only the wavelength absorptance maximum is tabulated in Table 1-2.

This example illustrates examples of the invention, with two peak absorptances, the first peak between 515 and 540 nm and the second peak between 565 and 590 nm, the ratio of the absorptance of the short wavelength peak to that of the long wavelength peak from 0.65 to 1.55, the minimum between the two absorptance peaks is between 520 and 560 nm, the ratio of the absorptance at the minimum to that of the lesser peaks is 0.86 or less, and the ratio of the absorptance at 490 nm to that of the greater peak is 0.60 or less. Examples of the invention exhibit dual sensitizing dye absorptance peaks, with absorption in both the short and long green of the spectrum, and with less absorption in the region from 520 to 560 nm. It demonstrates these properties using multiple dyes, including a sensitizing dye which alone absorbs in the short green region of the spectrum.

TABLE 1-2

| Sample Number (Inventive/ Comparative) | λ of Short Wave-length Peak (nm) | λ of Long Wave-length Peak (nm) | $A_{Short\ Wavelength\ Peak}/A_{Long\ Wavelength\ Peak}$ | λ of Minimum Absorption between Peaks (nm) | $A_{minimum}/A_{smaller\ absorption\ peak}$ | $A_{490}/A_{larger\ absorption\ peak}$ |
|---|---|---|---|---|---|---|
| 101 (Inv) | 526 | 572 | 1.36 | 548 | 0.41 | 0.38 |
| 102 (Inv) | 528 | 572 | 0.69 | 538 | 0.85 | 0.25 |
| 103 (Comp) | 526 | 556 | 0.82 | 540 | 0.82 | 0.36 |
| 104 (Inv) | 526 | 568 | 0.83 | 540 | 0.78 | 0.36 |
| 105 (Inv) | 526 | 572 | 1.10 | 544 | 0.68 | 0.40 |
| 106 (Inv) | 526 | 574 | 0.72 | 542 | 0.71 | 0.29 |
| 107 (Inv) | 526 | 582 | 0.69 | 542 | 0.53 | 0.28 |
| 108 (Inv) | 528 | 570 | 1.45 | 548 | 0.78 | 0.36 |
| 109 (Inv) | 528 | 570 | 1.00 | 548 | 0.76 | 0.46 |
| 110 (Inv) | 526 | 576 | 1.15 | 548 | 0.69 | 0.42 |
| 111 (Comp) | 526 | 574 | 0.54 | 546 | 0.39 | 0.20 |
| 112 (Comp) | 554 | 574 | 2.73 | 570 | 0.92 | 0.31 |
| 113 (Comp) | 526 | 567 | 5.16 | 552 | 0.86 | 0.41 |
| 114 (Comp) | — | 552 | | | | |
| 115 (Comp) | 528 | 554 | 0.78 | 536 | 0.94 | 0.36 |
| 116 (Comp) | 526 | 574 | 0.61 | 543 | 0.58 | 0.25 |
| 117 (Comp) | 532 | — | | | | |
| 118 (Comp) | 526 | — | | | | |
| 119 (Comp) | 526 | 580 | 2.00 | 560 | 0.79 | 0.39 |
| 120 (Comp) | — | 548 | | | | |
| 121 (Comp) | 574 | 584 | 1.40 | 582 | 0.98 | 0.11 |
| 122 (Comp) | 525 | 574 | 0.39 | 542 | 0.77 | 0.16 |
| 123 (Comp) | 526 | 568 | 1.97 | 548 | 0.79 | 0.40 |
| 124 (Comp) | 528 | 572 | 0.48 | 536 | 0.94 | 0.19 |
| 125 (Comp) | — | 574 | | | | |
| 126 (Comp) | 526 | 565 | 2.48 | 550 | 0.94 | 0.42 |
| 127 (Comp) | 538 | 566 | 1.11 | 552 | 0.90 | 0.43 |
| 128 (Comp) | 532 | 570 | 0.78 | 547 | 0.91 | 0.37 |
| 129 (Comp) | 532 | 564 | 1.04 | 550 | 0.88 | 0.47 |
| 130 (Comp) | 544 | 564 | 1.24 | 560 | 1.00 | 0.49 |

TABLE 1-2-continued

| Sample Number (Inventive/ Comparative) | λ of Short Wave-length Peak (nm) | λ of Long Wave-length Peak (nm) | $A_{Short\ Wavelength\ Peak}$/ $A_{Long\ Wavelength\ Peak}$ | λ of Minimum Absorption between Peaks (nm) | $A_{minimum}$/ $A_{smaller\ absorption\ peak}$ | $A_{490}$/ $A_{larger\ absorption\ peak}$ |
|---|---|---|---|---|---|---|
| 131 (Comp) | — | 540 | | | | |
| 132 (Comp) | 538 | 558 | 0.95 | 546 | 0.99 | 0.40 |
| 133 (Comp) | 538 | 552 | 1.05 | 550 | 1.00 | 0.43 |
| 134 (Comp) | — | 542 | | | | |
| 135 (Comp) | — | 558 | | | | |
| 136 (Comp) | 490 | 530 | 0.87 | 505 | 0.93 | 0.87 |
| 137 (Comp) | — | 550 | | | | |
| 138 (Comp) | 534 | — | | | | |
| 139 (Comp) | 546 | 564 | 0.91 | 552 | 0.93 | 0.25 |
| 140 (Comp) | 548 | 555 | 1.00 | 552 | 1.00 | 0.26 |
| 141 (Comp) | 542 | — | | | | |
| 142 (Comp) | 548 | — | | | | |
| 143 (Comp) | 542 | 562 | 1.65 | 556 | 0.98 | 0.35 |
| 144 (Comp) | 536 | 558 | 1.93 | 556 | 0.98 | 0.58 |
| 145 (Comp) | 534 | — | | | | |
| 146 (Comp) | 530 | 558 | 2.00 | 550 | 0.91 | 0.86 |
| 147 (Comp) | 536 | 558 | 2.32 | 556 | 0.99 | 0.64 |
| 148 (Comp) | 492 | 530 | 0.86 | 502 | 0.97 | 0.86 |
| 149 (Comp) | 530 | 580 | 1.18 | 552 | 0.66 | 0.82 |
| 150 (Comp) | 542 | — | | | | |
| 151 (Comp) | 544 | — | | | | |
| 152 (Comp) | 546 | — | | | | |
| 153 (Comp) | — | 564 | | | | |
| 154 (Comp) | 544 | — | | | | |
| 155 (Comp) | 546 | — | | | | |
| 156 (Comp) | 544 | 558 | 1.11 | 554 | 0.98 | 0.33 |
| 157 (Comp) | 544 | 562 | 0.96 | 550 | 0.98 | 0.35 |
| 158 (Comp) | — | 574 | | | | |

Example 2

Multilayer Color Negative

All of the following example AgBrI tabular silver halide emulsions were prepared containing either 3.7% or 4.5% total iodide distributed, such that the central portion of the emulsion grains contained no iodide and the perimeter area contained substantially higher iodide as described by Chang et al U.S. Pat. No. 5,314,793. The emulsions were precipitated using oxidized gelatin and contained 0.2 mg KSeCN per silver mole introduced at approximately 70% of the precipitation and 0.003 mg $K_2IrCl_6$ per Ag mole introduced at approximately 65%.

Emulsion E-1

Emulsion E-1 had an average thickness of 0.13 μm and average circular diameter of 1.27 μm. The emulsion was optimally chemically and spectrally sensitized by adding the antifoggant ADD-2, NaSCN, $8.0\times10^{-4}$ mole/mole Ag of the green sensitizing dye GSD-1 and then $2.0\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 61° C. The antifoggant-stabilizer, tetraazaindene, at a concentration of $2.9\times10^{-3}$ mole/mole silver, was added to the emulsion melt after the chemical sensitization procedure.

Emulsion E-2

Emulsion E-2 had an average thickness of 0.13 μm and average circular diameter of 0.79 μm. The emulsion was optimally chemically and spectrally sensitized by adding the antifoggant ADD-2, NaSCN, $8.9\times10^{-4}$ mole/mole Ag of the green sensitizing dye GSD-1 and then $2.2\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 61° C. The antifoggant-stabilizer, tetraazaindene, at a concentration of $2.9\times10^{-3}$ mole/mole silver, was added to the emulsion melt after the chemical sensitization procedure.

Emulsion E-3

Emulsion E-3 had an average thickness of 0.12 μm and average circular diameter of 0.65 μm. The emulsion was optimally chemically and spectrally sensitized by adding the antifoggant ADD-2, NaSCN, $9.9\times10^{-4}$ mole/mole Ag of the green sensitizing dye GSD-1 and then $2.5\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $2.9\times10^{-3}$ mole/mole silver, was added to the emulsion melt after the chemical sensitization procedure.

Emulsion E-4

Emulsion E-4 had an average thickness of 0.12 μm and average circular diameter of 1.24 μm. The emulsion was optimally chemically and spectrally sensitized by adding NaSCN, a dispersion of $2.3\times10^{-4}$ mole/mole Ag of the green sensitizing dye GSD-3, and then a dispersion of $7.6\times10^{-4}$ mole/mole Ag of the green sensitizing dye GSD-1 and $2.3\times10^{-4}$ of the green sensitizing dye GSD-4, $Na_3Au(S_2O_3)_2.2H_2O$, $Na_2S_2O_3.5H_2O$ and a benzothiazolium finish modifier. The emulsion was then subjected to a heat cycle to 65° C. The antifoggant-stabilizer, tetraazaindene, at a concentration of $2.9\times10^{-3}$ mole/mole silver, was added to the emulsion melt after the chemical sensitization procedure. This procedure gives a doubly peaked spectral absorption envelope with peaks at 532 nm and a smaller peak at 563 nm Emulsion E-5

Emulsion E-5 had an average thickness of 0.11 μm and average circular diameter of 0.79 μm. The emulsion was optimally chemically and spectrally sensitized by adding NaSCN, a dispersion of $1.7\times10^{-4}$ mole/mole Ag of the green sensitizing dye GSD-3, and then a dispersion of $5.7\times10^{-4}$ mole/mole Ag of the green sensitizing dye GSD-1 and $1.7\times10^{-4}$ of the green sensitizing dye GSD-4, $Na_3Au(S_2O_3)_2.2H_2O$, $Na_2S_2O_3.5H_2O$ and a benzothiazolium finish modifier. The emulsion was then subjected to a heat cycle to 64° C. The antifoggant-stabilizer, tetraazaindene, at a concentration of $2.9\times10^{-3}$ mole/mole silver, was added to the emulsion melt after the chemical sensitization procedure. This procedure gives a doubly peaked spectral absorption envelope with peaks at 532 nm and at 563 nm.

Emulsion E-6

Emulsion E-6 had an average thickness of 0.12 μm and average circular diameter of 1.24 μm. The emulsion was optimally chemically and spectrally sensitized by adding NaSCN, mixing dispersions of $4.1\times10^{-4}$ mole/mole Ag of the green sensitizing dye GSD-3 and $4.02\times10^{-4}$ mole/mole Ag of the green sensitizing dye GSD-5, $Na_3Au(S_2O_3)_2.2H_2O$, $Na_2S_2O_3.5H_2O$ and a benzothiazolium finish modifier. The emulsion was then subjected to a heat cycle to 65° C. The antifoggant-stabilizer, tetraazaindene, at a concentration of $2.9\times10^{-3}$ mole/mole silver, was added to the emulsion melt after the chemical sensitization procedure. This procedure gives a doubly peaked spectral absorption envelope with peaks at 526 nm and at 572 nm.

Emulsions E-7

Emulsion E-5 had an average thickness of 0.11 μm and average circular diameter of 0.79 μm. The emulsion was optimally chemically and spectrally sensitized by adding NaSCN, mixing dispersions of $5.12\times10^{-4}$ mole/mole Ag of the green sensitizing dye GSD-3 and $5.02\times10^{-4}$ mole/mole Ag of the green sensitizing dye GSD-5, $Na_3Au(S_2O_3)_2.2H_2O$, $Na_2S_2O_3.5H_2O$ and a benzothiazolium finish modifier. The emulsion was then subjected to a heat cycle to 65° C. The antifoggant-stabilizer, tetraazaindene, at a concentration of $2.9\times10^{-3}$ mole/mole silver, was added to the emulsion melt after the chemical sensitization procedure. This procedure gives a doubly peaked spectral absorption envelope with peaks at 526 nm and at 572 nm.

Multilayer Sample Y-1(Comparative)

The multilayer film structure utilized for this example is shown below, with structures of components provided at the end of the example section. Component laydowns are in grams per meter squared unless otherwise stated, emulsion sizes are reported in Diameter×Thickness in microns. 1,1'-(methylene bis(sulfonyl))bis-ethene hardener was used at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layers 6 and 7 were the experimental layers.

Layer 1 (Protective Overcoat Layer): gelatin at 0.89.

Layer 2 (UV Filter Layer): silver bromide Lippmann emulsion at 0.215, UV-1 at 0.097, UV-2 at 0.107, ADD-04 at 0.0012, and gelatin at 0.699.

Layer 3 (Fast Yellow Layer): a blend of two blue sensitized (with a mixture of BSD-1 and BSD-3) tabular silver iodobromide emulsions: (i) 3.2×0.13 μm, 3.7 mole % iodide at 0.430, (ii) 1.8×0.13 μm, 4.5 mole % iodide at 0.108. Yellow dye-forming coupler YC-1 at 0.247, IR-1 at 0.086, bleach accelerator-releasing coupler B-1 at 0.005 and gelatin at 0.915.

Layer 4 (Slow Yellow Layer): a blend of three blue sensitized tabular silver iodobromide emulsions: (i) 1.8×0.13 μm, 4.5 mole % iodide sensitized with a mixture of BSD-1 and BSD-3 at 0.296, (ii) 0.8×0.11 μm, 4.5 mole % iodide sensitized with a mixture of BSD-1 and BSD-3 at 0.387, (iii) 0.5×0.08 μm, 1.5 mole % iodide sensitized with a mixture of BSD-1 and BSD-2 at 0.194. Yellow dye-forming couplers YC-1 at 1.13, IR-1 at 0.247, IR-2 at 0.022, bleach accelerator-releasing coupler B-1 at 0.005, and gelatin at 2.41.

Layer 5 (Interlayer): OxDS-1 at 0.075, A-1 at 0.032, and gelatin at 0.538.

Layer 6 (Fast Magenta Layer): Emulsion E-1 at 0.538, magenta dye-forming coupler MC-1 at 0.086, masking coupler MM-1 at 0.032, IR-3 at 0.036, IR-4 at 0.003, OxDS-2 at 0.011, and gelatin at 0.943.

Layer 7 (Mid Magenta Layer): a blend of Emulsions E-2 at 0.473 and E-3 at 0.301. Magenta dye-forming coupler MC-1 at 0.247, masking coupler MM-1 at 0.118, IR-3 at 0.027, IR-5 at 0.024, OxDS-2 at 0.016, and gelatin at 1.47.

Layer 8 (Slow magenta layer): a blend of three green-sensitized (with a mixture of GSD-1 and GSD-2) silver iodobromide emulsions: (i) Emulsion E-3 at 0.172, (ii) a tabular emulsion, 0.5×0.1 μm, 4.5 mole % iodide at 0.215 and (iii) a cubic emulsion, 0.28 μm average spherical diameter, 3.5 mole % iodide at 0.161. Magenta dye-forming coupler MC-1 at 0.366, masking coupler MM-1 at 0.108, IR-5 at 0.031, OxDS-2 at 0.014, and gelatin at 1.52.

Layer 9 (Interlayer): YFD-1 at 0.043, A-1 at 0.043, OxDS-1 at 0.081 and gelatin at 0.538.

Layer 10 (Fast Cyan layer): a red-sensitized sensitized (with a mixture of RSD-1, RSD-2 and RSD-3) iodobromide tabular emulsion (1.4×0.13 μm, 3.7 mole % iodide) at 0.603, cyan dye-forming coupler CC-1 at 0.199, IR-6 at 0.043, IR-7 at 0.048, masking coupler CM-1 at 0.027, and gelatin at 1.62.

Layer 11 (Mid Cyan Layer): a red-sensitized (with a mixture of RSD-1, RSD-2, and RSD-3) tabular silver iodobromide emulsion (1.0×0.11 μm, 4.1 mole % iodide) at 0.699, cyan dye-forming coupler CC-1 at 0.366, yellow dye-forming coupler YC-1 at 0.108, IR-2 at 0.038, masking coupler CM-1 at 0.016, and gelatin at 1.15.

Layer 12 (Slow cyan layer): a blend of two red sensitized (both with a mixture of RSD-1, RSD-2, and RSD-3) tabular silver iodobromide emulsions: (i) 0.7×0.12 μm, 4.1 mole % iodide at 0.334 and (ii) 0.5×0.08 μm, 1.5 mole % iodide at 0.484. Cyan dye-forming coupler CC-1 at 0.583, masking coupler CM-1 at 0.011, IR-7 at 0.034, bleach accelerator releasing coupler B-1 at 0.086 and gelatin at 1.88.

Layer 13 (Interlayer): OxDS-1 at 0.075, A-1 at 0.043, and gelatin at 0.538.

Layer 14 (Antihalation layer): Black Colloidal Silver at 0.151, OxDS-1 at 0.081, ADD-2 at 0.270, ADD-1 at 0.001; ADD-3 at 0.007, and gelatin at 1.61.

Support: annealed poly(ethylene naphthalate) with an applied magnetic layer on the backside as described in *Research Disclosure,* November 1992, Item 34390 published by Kenneth Mason Publications, Ltd., Dudley Annex, 12a North Street, Emsworth, Hampshire PO10 7DQ, ENGLAND, and as described in Hatsumei Kyoukai Koukai Gihou No. 94-6023, published Mar. 15, 1994, available from the Japanese Patent Office.

Multilayer Sample Y-2 (comparative) was like Multilayer Sample Y-1 except Emulsion E-1 was removed from Layer 6 and replaced by Emulsion E-4 and Emulsions E-2 and E-3 were removed from Layer 7 and replaced by Emulsion E-5 at 0.774.

Multilayer Sample Y-3 (invention) was like Multilayer Sample Y-1 except Emulsion E-1 was removed from Layer 6 and replaced by Emulsion E-6 and Emulsions E-2 and E-3 were removed from Layer 7 and replaced by Emulsion E-7 at 0.774.

Chemical Structures for Examples

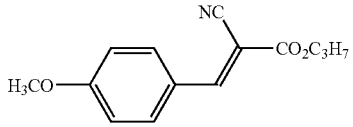

UV-1

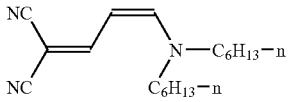

UV-2

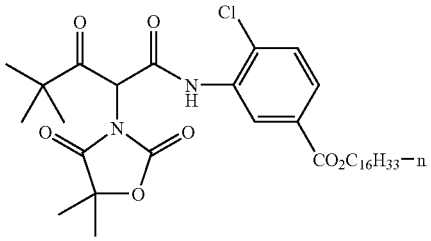

YC-1

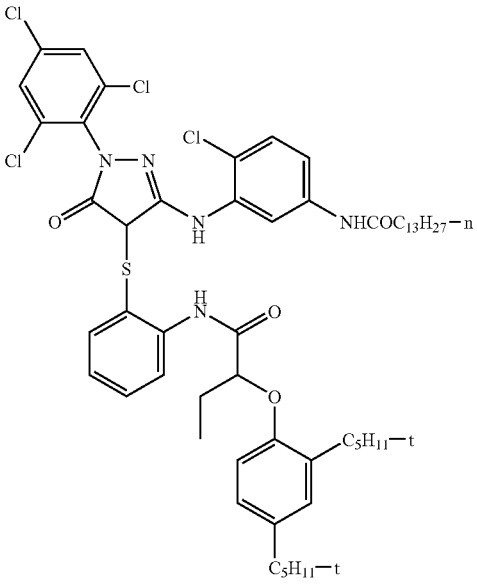

MC-1

-continued

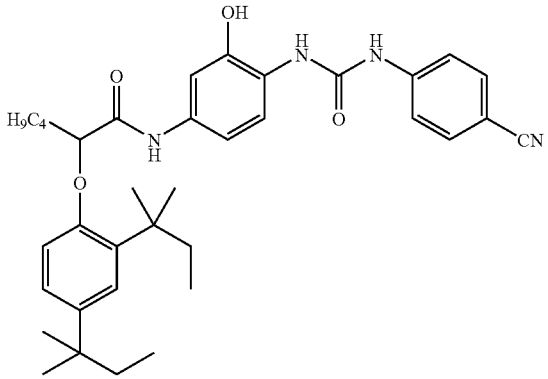

CC-1

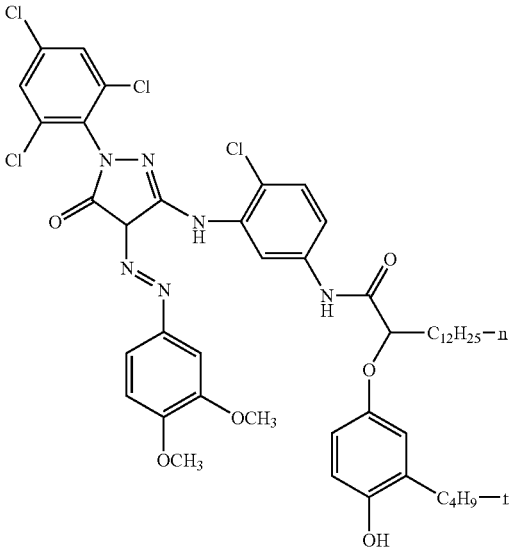

MM-1

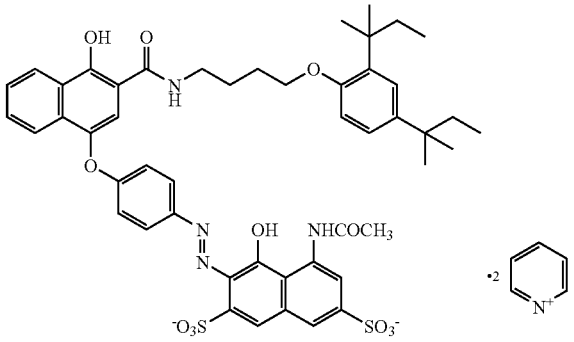

CM-1

-continued
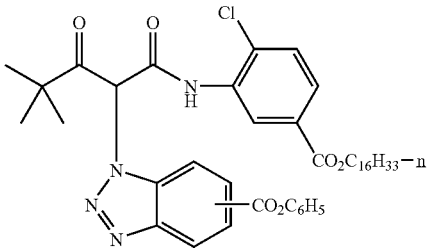
IR-1
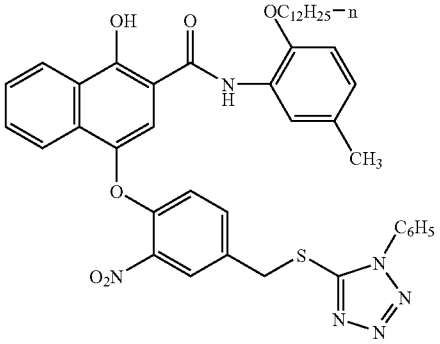
$IR_2$
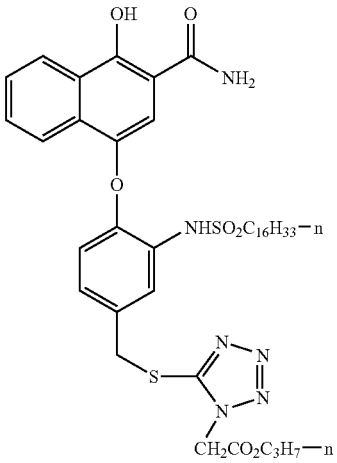
IR-3
-continued
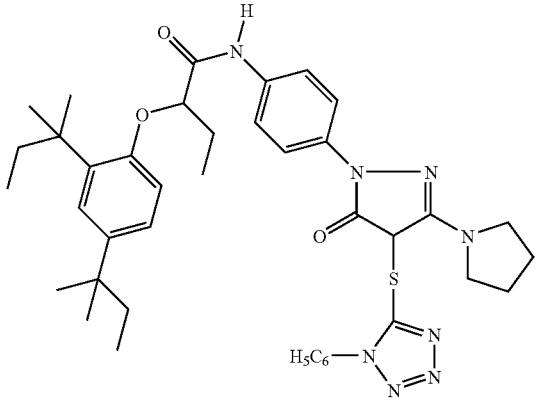
IR-4
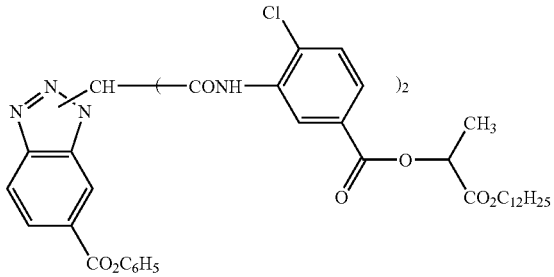
IR-5
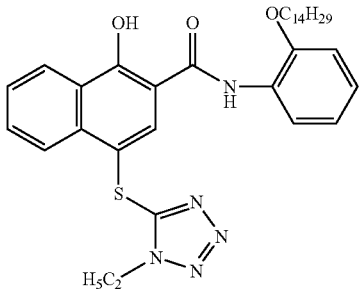
IR-6

-continued
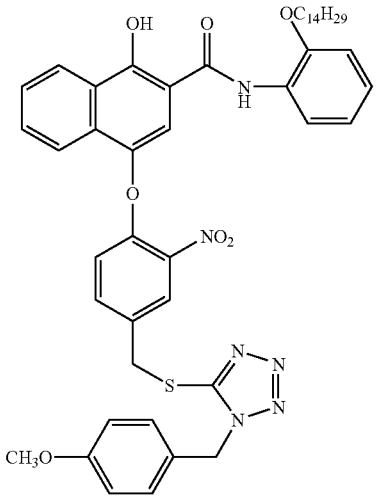
IR-7
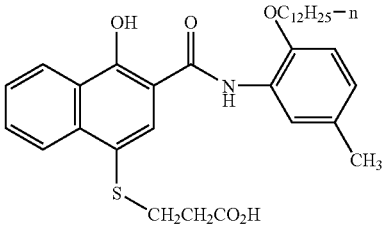
B-1
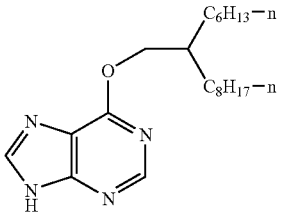
A-1
-continued
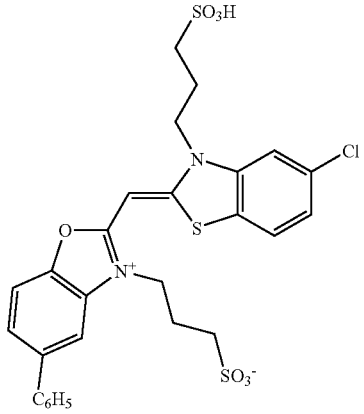
BSD-1
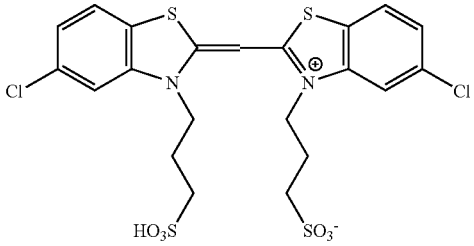
BSD-2
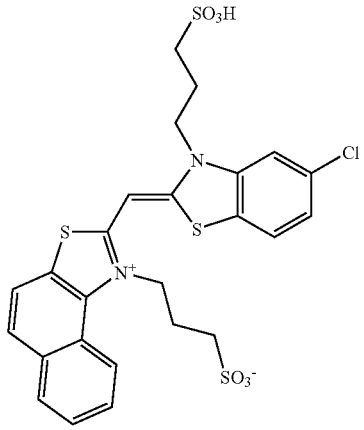
BSD-3

-continued
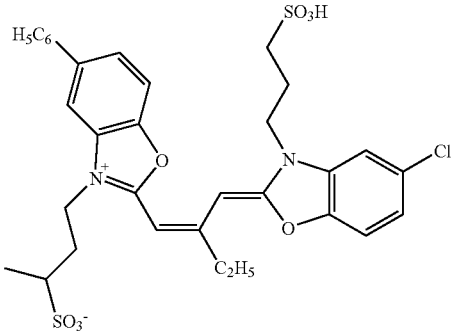
GSD-1
BSD-3
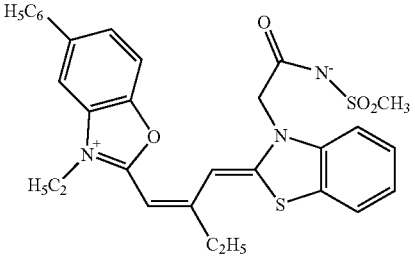
GSD-2
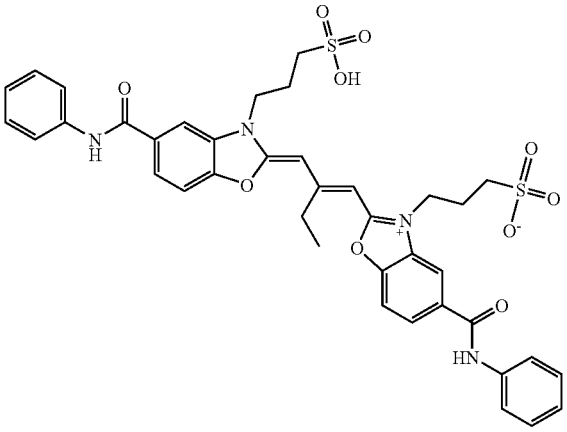
GSD-3
-continued
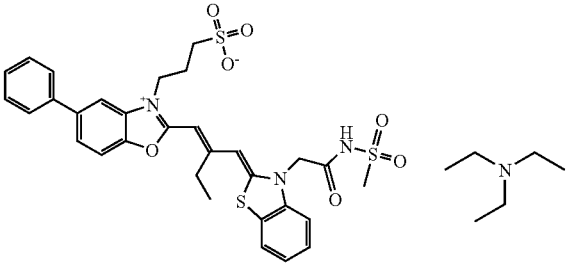
GSD-4
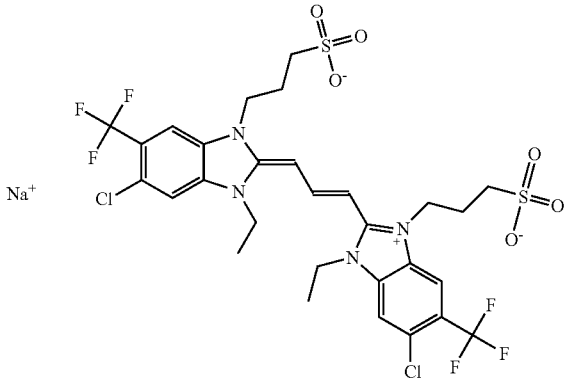
GSD-5
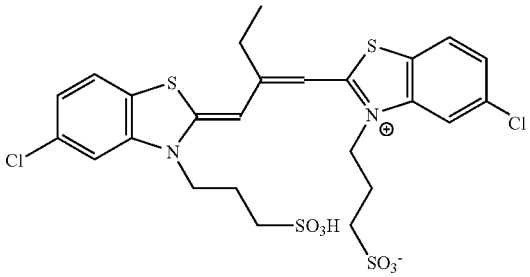
RSD-1
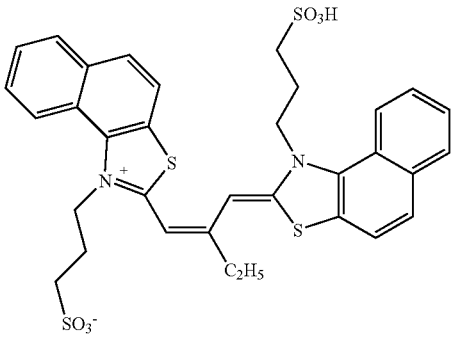
RSD-3

-continued

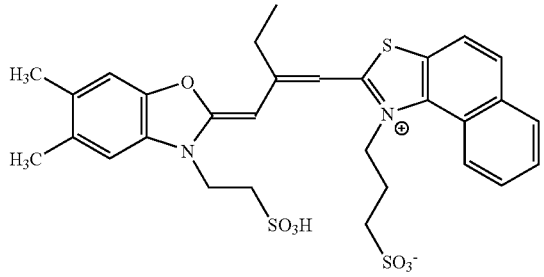

RSD-2

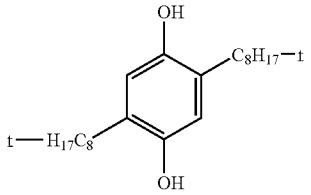

OxDS-1

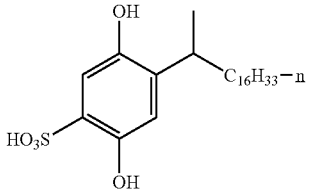

OxDS-2

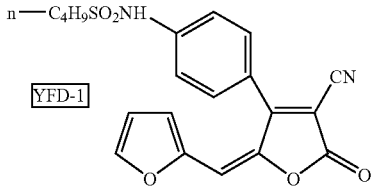

YFD-1

-continued

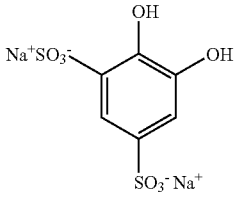

ADD-2

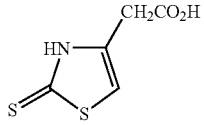

ADD-1

| | |
|---|---|
| ADD-3 | Sodium Hexametaphosphate |
| ADD-4 | $MnSO_4$ |

Samples of multilayers Y-1, Y-2 and Y-3 were given simultaneous exposures to two standard Macbeth Color Charts for eight tests. For each test, one Macbeth Color Chart was illuminated by daylight balanced electronic flash. The other Macbeth Color Chart was illuminated by one of eight artificial illuminants from the list below:

Artificial Illuminants

| Test/Code | Description | Manufacturer | CCT |
|---|---|---|---|
| 1. fluor CW | T12 Fluorescent coolwhite | Phillips | 4100K |
| 2. TL741 | T8 Fluorescent TL741 | Sylvania | 4100K |
| 3. Fluorspc30 | T12 Fluorescent Fluorspec30 | Phillips | 3000K |
| 4. TL835 | T8 Fluorescent TL741 | Sylvania | 3500K |
| 5. FluorWWD | T12 Fluorescent warmwhite deluxe | Phillips | 3000K |
| 6. MV | H33GL-400/DXmercury vapor | Sylvania | 3700 |
| 7. FluorCWD | T12 Fluorescent coolwhite deluxe | Phillips | 4100K |
| 8. FluorWW | T12 Fluorescent warmwhite | Phillips | 3000K |

The resultant exposed multilayers were processed through standard C41 processing and printed in a way that maintained neutral density for the gray scale of the Macbeth chart exposed to the daylight illuminant. Each of the color patches on the two Macbeth charts on each print was measured with an X-RITE Model 310 densitometer and the resultant densities translated into CIELAB space, L* a* b*. The difference between the two identical color patches on the print, one illuminated by daylight illuminant and one illuminated by the artificial illuminant, was calculated by the square-root of the sum of the squares of the differences between the L*a*b* values. For each print, the sum of the differences from all of the color patches was determined, and, for each illuminant, the print with the lowest sum of the differences has, on average, the least color change caused by illuminant. The print with the lowest sum of the differences was given a 1, and the highest sum of the differences was given a three.

The following table lists the results:

| | Multilayer | | |
|---|---|---|---|
| illuminant | Y1 | Y2 | Y3 |
| 1. fluor CW | 3 | 2 | 1 |
| 2. TL741 | 3 | 2 | 1 |
| 3. Fluorspc30 | 2 | 3 | 1 |
| 4. TL835 | 2 | 3 | 1 |
| 5. FluorWWD | 3 | 2 | 1 |
| 6. MV | 3 | 2 | 1 |
| 7. FluorCWD | 3 | 1 (tie) | 1 (tie) |
| 8. FluorWW | 1 | 2 | 3 |

For all but one illuminant the inventive example, Y3, showed the least color variation.

The invention has been described in detail with particular reference to preferred embodiments thereof, but it will be understood that variations and modifications can be effected within the spirit and scope of the invention.

What is claimed is:

1. A silver halide photographic element comprising a support bearing a cyan dye image forming unit comprised of at least one red sensitive silver halide emulsion, a magenta dye image forming unit comprised of at least one green sensitive silver halide emulsion, and a yellow dye image forming unit comprised of at least one blue sensitive silver halide emulsion; wherein the at least one green sensitive silver halide emulsion comprises two absorptance peaks, the first peak being between 515 and 540 nm (short wavelength peak) and the second peak being between 565 and 590 nm, (long wavelength peak) and wherein (a) the ratio of the absorptance peak value of the short wavelength peak to the absorptance peak value of the long wavelength peak is from 0.65 to 1.55, (b) the absorptance minimum between the two absorptance peaks is between 530 and 560 nm, (c) the ratio of the absorptance value at the absorptance minimum to that of the smaller absorptance peak is 0.86 or less, (d) the ratio of the absorptance at 490 nm to that of the highest absorptance peak is 0.60 or less.

2. The silver halide photographic element of claim 1 wherein the short wave length peak is between 515 and 535 and the long wavelength peak is between 565 and 585.

3. The silver halide photographic element of claim 1 wherein the short wavelength peak is between 515 and 530 and the long wavelength peak is between 565 and 580.

4. The silver halide photographic element of claim 1 wherein the ratio of the absorptance peak value of the short wavelength peak to the absorptance peak value of the long wavelength peak is from 0.75 to 1.45.

5. The silver halide photographic element of claim 1 wherein the absorptance minimum between the two absorptance peaks is between 535 and 555 nm.

6. The silver halide photographic element of claim 1 wherein the absorptance minimum between the two absorptance peaks is between 540 and 550 nm.

7. The silver halide photographic element of claim 1 wherein the at least one green sensitive emulsion has been sensitized with at least one green sensitizing dye represented by formula (I):

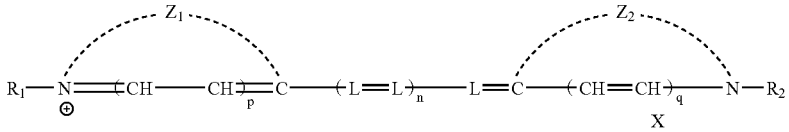

(I)

wherein each of $R_1$ and $R_2$ independently represents a substituted or unsubstituted alkyl group or substituted or unsubstituted aryl group; each of $Z_1$ and $Z_2$ independently represents the atoms necessary to complete a 5- or 6-membered heterocyclic ring system; each L is a substituted or unsubstituted methine group; each of p, q, and n is independently 0 or 1; and X is a counterion as necessary to balance the charge.

8. The silver halide photographic element of claim 1 wherein the at least one green sensitive emulsion has been sensitized with at least one green sensitizing dye represented by formula (II):

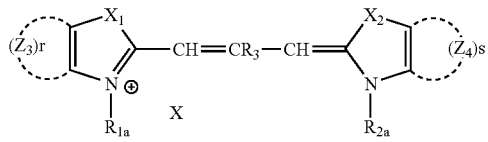

(II)

wherein each of $R_{1a}$ and $R_{2a}$ independently represents a substituted or unsubstituted alkyl group or substituted or unsubstituted aryl group; each of r and s is independently 0 or 1; each of $Z_3$ and $Z_4$ independently represents the atoms necessary to complete a fused benzene, naphthalene, pyridine, or pyrazine ring, which can be further substituted; $R_3$ is a substituted or unsubstituted alkyl group, or a substituted or unsubstituted aryl group; $X_1$ and $X_2$ can each individually be O, S, or Se, N—$R_4$, where $R_4$ is a substituted or unsubstituted alkyl group, or substituted or unsubstituted aryl group, with the proviso that $X_1$ and $X_2$ are not both S or Se; and when r or s is 0, the 5-membered ring containing $X_1$ or $X_2$, respectively, may be further substituted at the 4 and/or 5 position and X is a counterion as necessary to balance the charge.

9. The silver halide photographic element of claim 1 wherein the at least one green sensitive emulsion has been sensitized with at least one green sensitizing dye represented by formula SG-I, SG-II, SG-III, or SG-IV:

SG-I

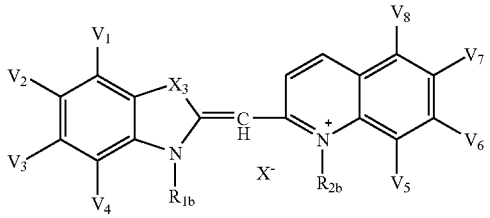

wherein each of $R_{1b}$ and $R_{2b}$ independently represents a substituted or unsubstituted alkyl group or substituted or unsubstituted aryl group; $X_3$ is S or Se, and each of $V_1$ to $V_8$ independently represents hydrogen, a substituted or unsubstituted alkyl group, a substituted or unsubstituted aromatic group, a halogen atom, a cyano group, a sulfamyl, an alkoxycarbonyl, an acylamino group, a carbamoyl group, a carboxy group, or a substituted or unsubstituted alkoxy group and adjacent pairs of substituents $V_1$ to $V_7$ may be joined to form a fused carbocyclic, heterocyclic, aromatic, or heteroaromatic ring, which may be substituted and X is a counterion as necessary to balance the charge;

SG-II

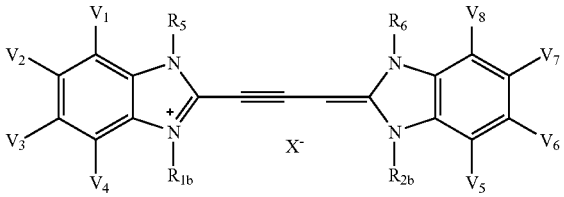

wherein $R_{1b}$, $R_{2b}$, $V_1$–$V_8$ and X have the same meaning as in structure SG-I; and each of $R_5$ and $R_6$ independently represents a substituted or unsubstituted alkyl group or substituted or unsubstituted aryl group;

SG-III

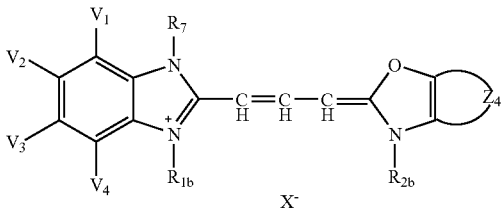

wherein $R_{1b}$, $R_{2b}$, $V_1$–$V_4$ and X, have the same meaning as in formula SG-I; $Z_4$ represents the atoms necessary to complete a fused benzene, naphthalene, pyridine, or pyrazine ring, which can be further substituted; and $R_7$ represents a substituted or unsubstituted alkyl group, or substituted or unsubstituted aryl group;

SG-IV

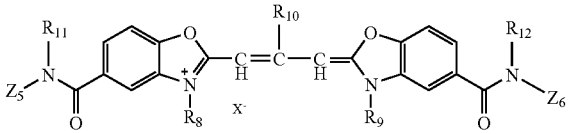

wherein $R_{10}$ is hydrogen or a substituted or unsubstituted aryl group or a substituted or unsubstituted alkyl group; $R_8$ and $R_9$ are both independently substituted or unsubstituted alkyl groups; $R_{11}$ and $R_{12}$ are independently hydrogen or a substituted or unsubstituted alkyl group; $Z_5$ and $Z_6$ each individually represents a substituted or unsubstituted aromatic group and X is one or more ions needed to balance the charge on the molecule.

10. The silver halide photographic element of claim 9 wherein the at least one green sensitive emulsion has been sensitized with at least one green sensitizing dye represented by formula SG-IV;

SG-IV

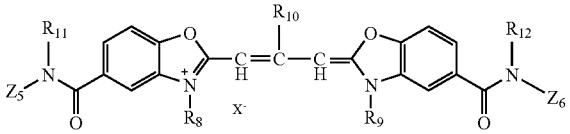

wherein $R_{10}$ is hydrogen or a substituted or unsubstituted aryl group or a substituted or unsubstituted alkyl group; $R_8$ and $R_9$ are both independently substituted or unsubstituted alkyl groups; $R_{11}$ and $R_{12}$ are independently hydrogen or a substituted or unsubstituted alkyl group; $Z_5$ and $Z_6$ each individually represents a substituted or unsubstituted aromatic group and X is one or more ions needed to balance the charge on the molecule.

11. The silver halide photographic element of claim 1 wherein the short wavelength dye is a J-aggregate dye.

12. The silver halide photographic element of claim 7 wherein the at least one green sensitizing dye is a J-aggregate dye.

13. The silver halide photographic element of claim 8 wherein the at least one green sensitizing dye is a J-aggregate dye.

14. The silver halide photographic element of claim 9 wherein the at least one green sensitizing dye is a J-aggregate dye.

15. The silver halide photographic element of claim 10 wherein the at least one green sensitizing dye is a J-aggregate dye.

16. The silver halide photographic element of claim 1 wherein the at least one green sensitive emulsion has been sensitized with at least one of the following green sensitizing dyes:

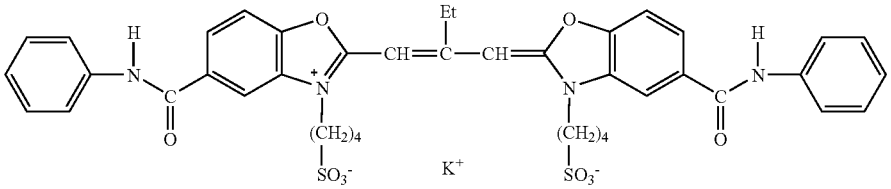
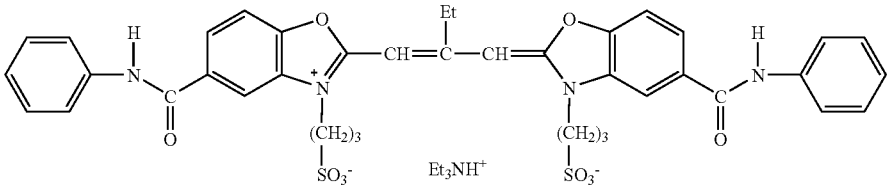
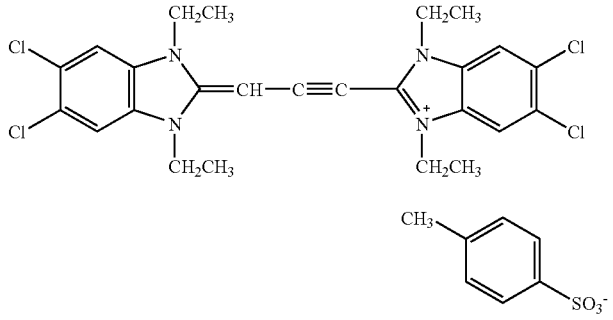
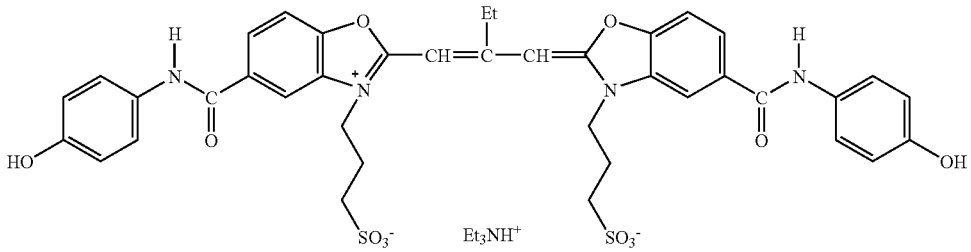
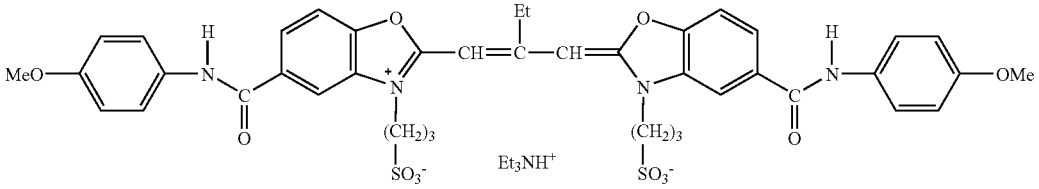
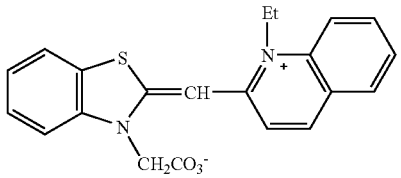
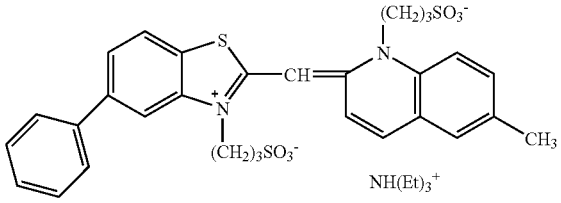

-continued
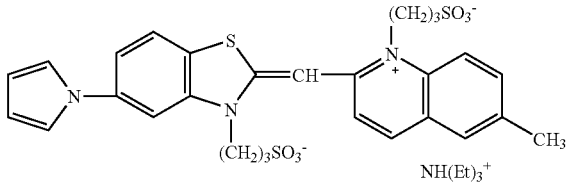
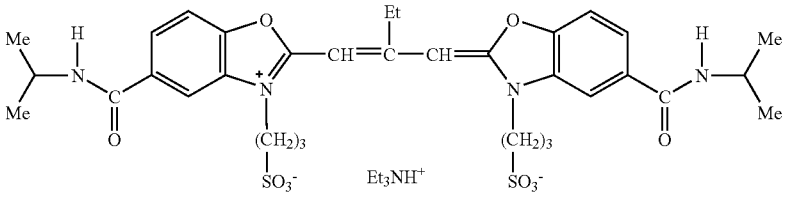
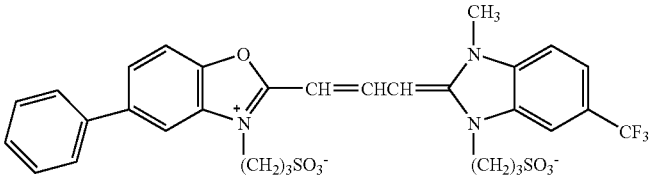
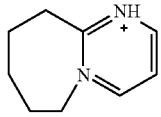
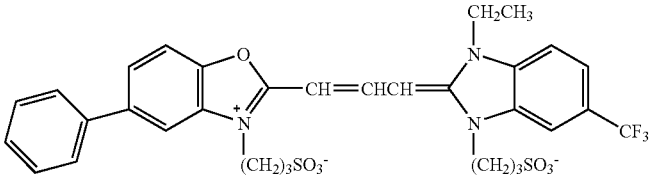
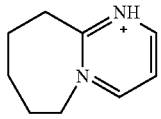
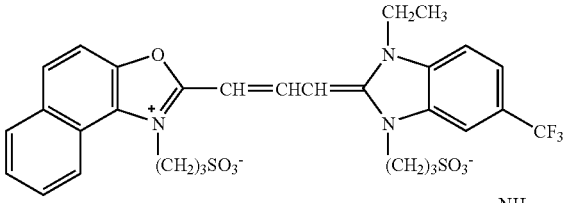
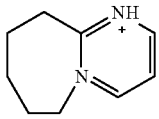
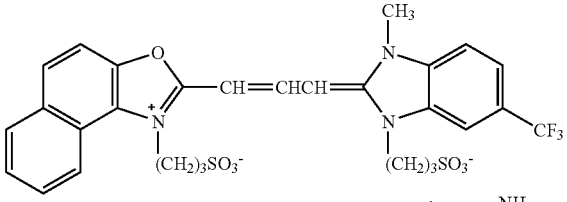
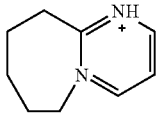

-continued
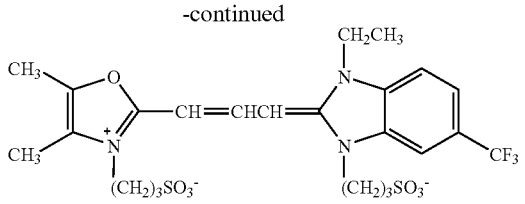
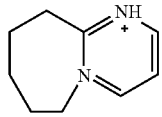
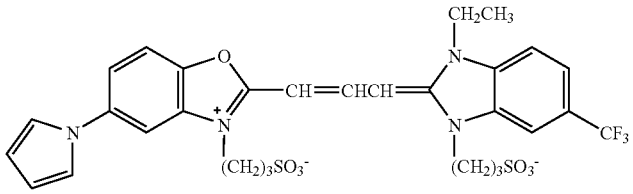
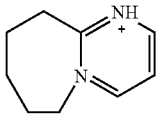
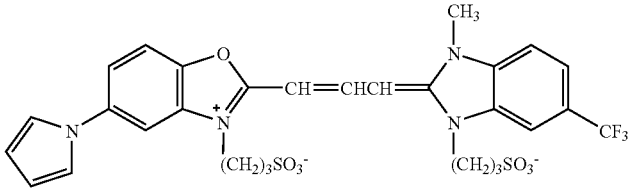
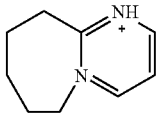
or
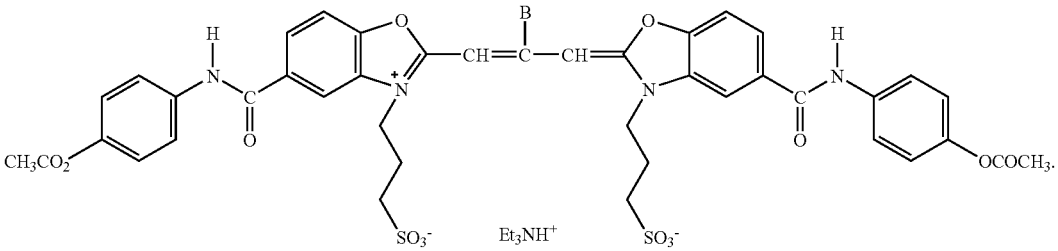
* * * * *